United States Patent [19]

Manabe et al.

[11] Patent Number: 5,009,146

[45] Date of Patent: Apr. 23, 1991

[54] ELECTRONIC PERCUSSION INSTRUMENT HAVING A MEMORY FUNCTION AND A MUSICAL TONE PARAMETER CONTROL FUNCTION

[75] Inventors: Hajime Manabe, Higashiyamato; Yoshiyuki Murata, Tachikawa, both of Japan

[73] Assignee: Casio Computer Co., Ltd., Tokyo, Japan

[21] Appl. No.: 368,249

[22] Filed: Jun. 19, 1989

[30] Foreign Application Priority Data

Jun. 23, 1988 [JP] Japan ..... 63-83265

[51] Int. Cl.[5] ..... G10H 1/053; G10H 1/18

[52] U.S. Cl. ..... 84/615; 84/622; 84/627

[58] Field of Search ..... 84/626, 627, 633, 622–625, 84/659–663, 665, 687–690, 692–703, 711, 615, DIG. 7, DIG. 12, DIG. 24

[56] References Cited

U.S. PATENT DOCUMENTS

| | | | |
|---|---|---|---|
| 3,546,353 | 10/1968 | Jenny . | |
| 4,080,863 | 3/1978 | Groeschel | 84/665 X |
| 4,121,488 | 10/1978 | Akiyama . | |
| 4,301,704 | 11/1981 | Nagai et al. | 84/633 X |
| 4,418,598 | 12/1983 | Klynas . | |
| 4,479,412 | 10/1984 | Klynas . | |
| 4,552,051 | 11/1985 | Takeuchi | 84/626 |
| 4,581,972 | 4/1986 | Hoshino . | |
| 4,581,973 | 4/1986 | Hoshino . | |
| 4,679,479 | 7/1987 | Koyamato . | |
| 4,781,097 | 11/1988 | Uchiyama et al. . | |
| 4,892,023 | 1/1990 | Takeuchi et al. | 84/DIG. 7 |

FOREIGN PATENT DOCUMENTS

| | | |
|---|---|---|
| 58-16693 | 2/1983 | Japan . |
| 59-5912 | 2/1984 | Japan . |
| 59-94399 | 6/1984 | Japan . |
| 60-76399 | 5/1985 | Japan . |
| 61-239299 | 10/1986 | Japan . |
| 62-96996 | 5/1987 | Japan . |
| 62-116300 | 7/1987 | Japan . |
| 62-157092 | 7/1987 | Japan . |
| 2183076 | 5/1987 | United Kingdom . |
| 86/01927 | 3/1986 | World Int. Prop. O. . |

*Primary Examiner*—Stanley J. Witkowski

*Attorney, Agent, or Firm*—Frishauf, Holtz, Goodman & Woodward

[57] ABSTRACT

During percussion performance, percussion data corresponding to states of percussion sequentially detected by percussion-detection section and tone pitch data corresponding to the sequentially struck percussion members are stored. The stored percussion data and tone pitch data are sequentially read out to generate musical tones, each having a tone pitch corresponding to the tone pitch data, in accordance with the percussion data. Parameters of musical tones to be generated or being generated are controlled in accordance with instructions of a parameter indication section provided on a striking member.

34 Claims, 11 Drawing Sheets

ELECTRONIC PERCUSSION INSTRUMENT HAVING A MEMORY FUNCTION AND A MUSICAL TONE PARAMETER CONTROL FUNCTION

BACKGROUND OF THE INVENTION

1. Field of the Invention

The present invention relates to an electronic percussion instrument used for playing a melody by percussion operation similar to that in playing an acoustic percussion instrument such as a zylophone, marimba and the like, and more particularly, to an electronic percussion instrument capable of storing and/or reproducing a melody performance state and a chord performance state in real time.

2. Description of the Related Art

With recent, rapid developments of electronic technology and digital technology, various types of electronic percussion instruments have been developed, which electronically generate particular musical tones in response to percussion operation. These electronic percussion instruments can be classified into five types of instruments, such as (A) an electronic percussion instrument of a drum type, (B) an electronic percussion instrument of a drum stick type, (C) an electronic percussion instrument of a guitar type, (D) an electronic percussion instrument of a step-on type and (E) an electronic percussion instrument of a sound plate type.

Among the above mentioned electronic percussion instruments, any of the electronic percussion instrument of a drum type, the electronic percussion instrument of a drum stick type and the electronic percussion instrument of a guitar type is not capable of selectively generating a musical tone having a particular tone pitch in response to striking operation. Therefore, these instruments can not be used for playing melodies and chords. On the contrary, the above mentioned electronic percussion instrument of a step type and electronic percussion instrument of a sound plate type are capable of selectively generating a musical tone having a particular tone pitch in response to striking operation or stepping operation. Therefore, these instruments can be used for playing moldies and chords.

The electronic percussion instrument of a drum type (A) is a musical instrument which has a drum, to the struck portion of which a vibration sensor is attached, and which generates relevent acoustic signals or musical tones on the basis of output signals output from the vibration sensor in response to striking operation. This type of electronic percussion instruments are disclosed in, for example, the following patent publications:

(1) Japanese Utility Model Disclosure (Kokai) No. 58-16693 (disclosed on Feb. 1, 1983), inventor: Kunihiko Watanabe, applicant: Nippon Gakki Seizo Kabushiki Kaisha)

(2) U.S. Pat. Nos. 4581972 and 4581973 (issued on Apr. 15, 1986, inventor: Yoshiki Hoshino, assignee: Hoshino Gakki)

(3) U.S. Pat. No. 4418598 (issued on Dec. 6, 1983, inventor: Scott S. Klynas, assignee: Mattel, Inc.)

(4) U.S. Pat. No. 4479412 (issued on Oct. 30, 1984, inventor Scott S. Klynas, assignee: Mattle, Inc.)

(5) U.S. Pat. No. 4679479 (issued on July 14, 1987, inventor: Hisakazu Koyamato, assignee: Nippon Gakki Seizo Kabushiki Kaisha)

(6) Japanese Utility Model Disclosure (Kokai) No. 60-76399 (disclosed on May 28, 1985, inventor: Eiichiro Aoki, applicant: Nippon Gakki Seizo Kabushiki Kaisha)

Technology relating to the present invention is disclosed in U.S. Pat. No. 4781097 (issued on Nov. 1, 1988, inventors: Shigeru Uchiyama et al., assignee: Casio Computer Co., Ltd. the same assignee of the present invention.)

The above described electronic percussion instrument of a drum stick type (B) is an electronic musical instrument which outputs relevent acoustic signals or musical tone signals on the basis of output signals output from a stick shape striking member such as a drum stick and a mallet. This stick shape striking member is provided with a vibration sensor which generates output signals to be used for the above musical instrument in response to striking and/or swinging operation of the same. This type of the electronic musical instruments are disclosed in, for example, the following patent publication:

(1) Japanese Utility Model Publication No. 59-5912 (published on Feb. 22, 1984, inventor: Shouiti Momobe, applicant: Nippon Gakki Seizo Kabushiki Kaisha)

(2) Japanese Pat. Disclosure (Kokai) No. 62-96996 (disclosed on May 6, 1987, inventor: Yoshiyuki Murata, applicant: Casio Computer Co., Ltd.)

(3) Japanese Utility Model disclosure (Kokai) No. 62-116300 (disclosed on July 23, 1987, inventor: Shinji Nagumo, applicant: Casio Computer Co., Ltd.)

(4) U.K. Patent Application GB2183076A (disclosed on May 28, 1987, inventor: Ian Barry Tragen, applicant: Ian Barry Tragen.)

This type of an electronic percussion instrument is disclosed in U.S. patent application Ser. No. 053384 (filed on May 22, 1987, inventors: Yukio Kashio et al, assigneee: Casio Computer Co., Ltd. the same assignee of the present application)

The above mentioned electronic percussion instrument of a guitar type (C) is an electronic musical instrument of a guitar shape, which is provided with manual switches and is caused to generate musical tone signals having particular timbre in response to striking operation when the manual switches are struck. This type of electronic musical instruments are disclosed in, for example, the following patent publications:

(1) Japanese Patent Disclosure (Kokai) No. 62-157092 (disclosed on July 13, 1987, inventor: Sigeru Imura applicant: Sony Corp.)

(2) PCT International Disclosure No. WO 86/01927 (disclosed on March 27, 1986, inventor: Jones, Peter, Stephan, applicant: Dynacord Electronic Und Geratebau Gmbh & Co., Kg)

The above electronic percussion instrument of a step-on type (D) is an electronic musical instrument which has a flexible mat within which is arranged a plurality of flexible switches in order of the tone scale and which is caused to generate musical tones each having a corresponding tone pitch when the flexible switches are stepped on. This type of electronic musical instruments are disclosed in, for example, U.S. Pat. No. 4121488 (issued on Oct. 24, 1978, inventor: Kakunosuke Akiyama, assignee: Nep Company, Ltd.)

The above-mentioned electronic percussion instrument of a sound plate type (E) is an electronic musical instrument which has a set of sound plates arranged in order of tone pitch and each provided with a pressure sensor and which is caused to generate musical tones each having a tone pitch corresponding to the struck sound plate when the sound plates are struck with a mallet. This type of electronic percussion instruments are disclosed in, for example, the following patent disclosure:

(1) Japanese Patent Disclosure (Kokai) No. 61-239299 (disclosed on Oct. 24, 1986, inventors: Akihiko Takeuchi et al, applicant: Nippon Gakki Seizo Kabushiki Kaisha.)

(2) U.S. Pat. No. 3546353 (issued on Dec. 8, 1970, inventor: Georges Jenny, assignee: Societe a Responsabitte Limitee dite)

(3) Japanese Utility Model Disclosure (Kokai) No. 59-94399 (disclosed on June 27, 1984, inventor: Ziro Aimono, applicant: Casio Computer Co., Ltd.)

None of the above mentioned conventional electronic percussion instruments, however, is capable of storing in real time tone pitch data corresponding to the struck members in accordance with striking operation or is capable of reading out in real time the stored tone pitch data to sequentially reproduce musical tones each having a tone pitch corresponding to the read out tone pitch data.

Therefore, it was impossible for a beginner player to exercise a percussion performance, listening to a model percussion performance given by a musician which has been recorded or impossible to check poor portions in his percussion operation listening to his own percussion performance. As a result, it was difficult to effectively exercise a percussion performance. Note that the electronic percussion instrument described in the above mentioned Japanese Utility Model Disclosure (Kokai) Nos. 58-16693 and 60-76399, and U.S. Pat. No. 4418598 is capable of storing in real time output signals generated by the vibration sensor or a touch sensor provided on the drum, but is not capable of selectively generating musical tones each having a particular tone pitch in response to percussion operation. Therefore, this electronic musical instrument can not store melody data and chord data in real time.

The electronic percussion instrument described in the above Japanese Patent Disclosure (Kokai) No. 61-23929 can be controlled to switch timbre of a musical tone to be generated, stop sounding of a musical tone and add tremolo, vibrato, sustain effects and the like to musical tones by operating switches provided on the instrument body. Therefore, in this electronic musical instrument, various timbre of performance by percussion operation can be enjoyed and a variety of performance expressions can be realized. However, in this electronic percussion instrument, the musical tone parameters for timbre, various effects and the like are set by operating switches provided on the instrument body. Therefore, it is difficult to change characters of musical tone being sounded without causing any trouble in performance, while the player is playing the percussion instrument with mallets in both his hands.

In the electronic percussion instrument disclosed in the above Japanese Patent Disclosure (Kokai) No. 61-239299, striking intensity and striking position on the sound plate are detected and the musical tone characters such as tone pitch, timbre, tone volume, i.e, musical tone parameters are controlled in accordance with the detected striking intensity and striking positions. Therefore, in this percussion instrument, without operation of various switches provided on the instrument body, the musical tone characters can be controlled depending on the method for playing the instrument. However, the characters of a musical tone are determined at the time of striking operation. As a result, it is impossible to control or change the parameters of a musical tone being sounded.

SUMMARY OF THE INVENTION

The present invention has been made to overcome the above mentioned conventional disadvantages caused in the electronic percussion instruments mentioned above.

An object of the present invention is to provide an electronic percussion instrument used for effectively exercising and practising percussion performance.

Another object of the present invention is to provide an electronic percussion instrument capable of storing precisely and in real time, for example, model percussion performances by musicians and his own percussion performances.

An additional object of the present invention is to provide an electronic percussion instrument capable of storing in real time, for example, melody data and chord data in response to percussion operation.

A further object of the present invention is to provide an electronic percussion instrument which allows the player to control to rapidly and surely change parameters (for example, timbre, tone pitch, tone effect) of a musical tone being sounded or of a musical tone to be generated, even while he is performing percussion operation with striking members in both his hands.

According to the present invention, to achieve the above mentioned objects, there is provided an electronic percussion instrument comprising:

a plurality of percussion members adapted to be struck, each provided for each of tone pithes;

percussion detection means for detecting a state of percussion imparted to said percussion members;

performance-data generation means for generating during a percussion performance, percussion data and tone pitch data, said percussion data corresponding to states of percussion sequentially detected by said percussion detection means and said tone pitch data corresponding to the struck percussion members; and memory means for sequentially storing the percussion data and the tone pitch data generated by said performance-data generation means.

The expression in claim 1, ". . . provided for each of tone pitches" has a wide concept including ". . . provided in order of the musical scale . . ." and ". . . provided regardless of the order of the musical scale . . . ".

According to the present invention, there is provided an electronic percussion instrument comprising:

a plurality of percussion members adopted to be struck, each provided for each of tone pitches;

at least one striking member used for striking said percussion member;

designation-data output means provided on said striking member, for outputting designation data to designate a parameter of a musical tone to be generated;

percussion detection means for detecting a state of percussion applied to said percussion members;

performance-data generation means for generating, during a percussion performance, percussion data and tone pitch data, said percussion data corresponding to states of percussion detected sequentially by said percussion detection means and said tone pitch data corresponding to the struck percussion members; and memory means for sequentially storing the percussion data and the tone pitch data generated by said performance-data generation means and the designation data output by said designation-data output means.

The term, "a parameter of a musical tone has wide concept including various effect to be applied to a musical tone such as tremolo effect, vibrato effect and the like, in addition to timbre, tone pitch and tone volume.

According to the present invention, there is provided an electronic percussion instrument comprising:

a plurality of percussion members adopted to be struck, provided for a plurality of tone pitches;

striking member used for striking said percussion members;

percussion detection means for detecting a state of percussion applied to said percussion members to output a corresponding sensed signal;

tone-pitch data generation means for generating tone pitch data corresponding to said percussion members, percussion applied to which is detected, on the basis of the sensed signal output by the percussion detection means;

indication signal output means provided on said striking members, for outputting an indication signal to indicate a parameter of a musical tone to be generated; and control means for controlling a parameter having a tone pitch corresponding to the tone pitch data in accordance with the indication signal output by said indication signal output means, said tone pitch data generated by said tone pitch data generation means on the basis of the sensed signal output by said percussion detection means.

Now, hereinafter, embodiments of the present invention will be described with reference to the drawings.

Whole Construction of a System

Figure 1:
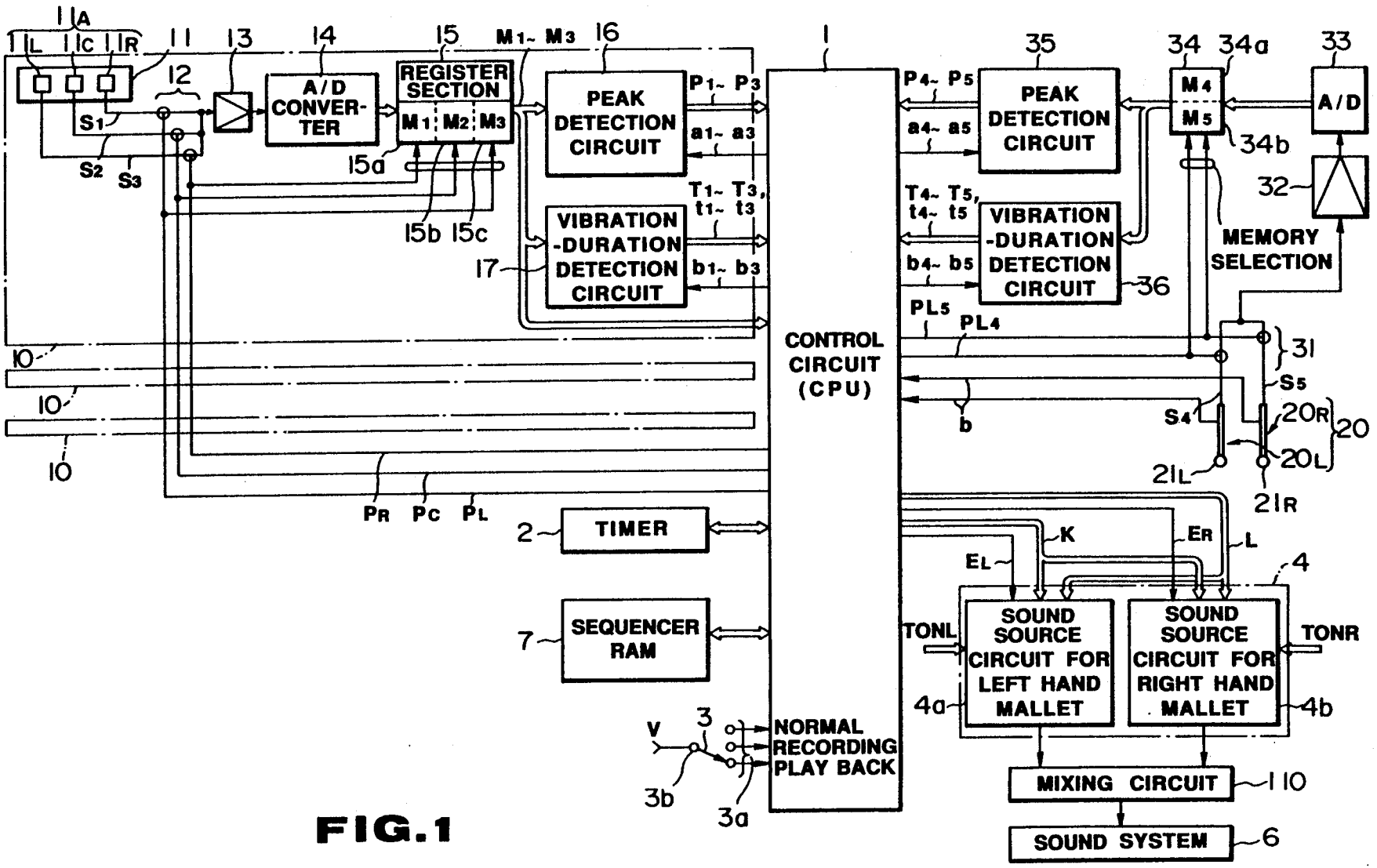
FIG. 1 is a view showing a system construction of a first embodiment of the present invention applied to an electronic sound-plate percussion instrument.

FIG. 1 is a view showing an overall system construction of a first embodiment according to the present invention applied to an electronic percussion instrument.

A control circuit (CPU) 1 comprises a micro-processor and executes a program stored in an internal Read Only Memory (ROM) (not shown) to control the overall system.

A timer 2 generates various timer-interruptions at predetermined periods to apply the same to the control circuit 1.

When received the timer-interruptions, the control circuit 1 reads out the program corresponding to the timer-interruptions to execute various processings and counts the present time.

A mode selection switch 3 serves to select a mode out of a normal mode, a recording mode and a play back mode.

In the normal mode, percussion performance is executed in real time and in the recording mode, melodies played in percussion performance are recorded in real time. In the play back mode, the melodies recorded in the recording mode are reproduced for automatic play.

When the mode selection switch 3 is operated, a switch terminal **3*a* corresponding to the selected mode and a terminal 3*b* to which voltage V is applied from a power supply (not shown) are connected and thereby a logical value "1" is applied through an interface (not shown) to an input port of the control circuit 1 connected to the switch terminal 3*a* corresponding to the selected mode. The control circuit 1 scans at a predetermined period the input ports corresponding to the switch terminals 3*a* of respective modes, when received the timer interruption from the timer 2** and discriminates what mode is selected at present on the basis of the value of the input ports. The mode selected at present, which is discriminated as a result of the scan, is stored in a predetermined memory area (not shown).

A sound source circuit 4 serves to generate musical tones corresponding to musical tone control data supplied from the control circuit 1. The sound source circuit 4 comprises a sound source circuit **4*a* for a left hand mallet and a sound souce circuit 4*b* for a right hand mallet. The circuit construction of the sound source circuit 4** will be described in detail later.

A sound system 6 comprises an amplifier and a speaker and produces sounds of musical tones generated by the sound source circuit 4.

A sound-plate percussion detection selection 10 is a block for detecting percussion intensity of a sound plates 11 and vibration duration of the sound plates 11, both caused when a player striks the sound paltes 11 with a left hand mallet 20L or a right hand mallet 20R. The sound-plate percussion detection section 10 is provided for each of the sound plates 11.

The sound-plate percussion detection section 10 comprises a sound plate 11, a sound plate sensor 11A installed in the sound plate 11, a gate 12, an amplifier 13, and A/D converter 14, a register section 15, a peak detection section 16 and a vibration-duration detection circuit 17.

The sound-plate sensor 11A serves to sense vibration state of a struck sound plate and can independently sense vibration state of each divided portion of the sound plate 11, which is equally divided into three portions. In the present embodiment, as will be described later, the sound-plate sensor 11A is installed in the sound plate 11. A sound plate 11 is prepared for each of tone pitches ranging over several octaves. A plurality of the tone pitches 11 having a similar shape to those of a conventional acoustic percussion instrument are disposed on a supposed plane in order of the tone pitch.

In FIG. 1, a symbol 11L denotes a sensor for sensing vibration of the left hand divided portion of the sound plate 11, a symbol 11C denotes a sensor for sensing vibration of the center divided portion of the sound plate 11 and a symbol 11R denotes a sensor for sensing vibration of the right hand divided portion of the sound plate 11.

When the sound plate 11 is struck with mallets 20 (hereinafter, the mallets 20L and 20R are collectively referred to as mallets 20), the sound plate 11 starts its vibration. The sensed signals S1, S2 and S3 representing vibrations at each portion on the sound plate 11 are output from the sound-plate sensors 11L, 11C and 11R, respectively. The output signals S1, S2 and S3 of the sound-plate sensors 11L, 11C and 11R are vibration waveforms representing vibration of each portion of the sound plate 11. The maximum amplitude value of the vibration and the vibration duration are almost inversely proportional to a distance between the struck position and the position at which the sound-plate sensor is installed. Therefore, the peak value of the amplitude of the vibration and the vibration duration are maximum, when these values are obtained from the vibration waveform output from the sound-plate sensor which is installed most close to the struck portion on the sound plate 11. The stronger the percussion operation to the sound plate 11 is, the larger the peak value of the amplitude and the vibration duration of the sensed signals S1, S2 and S3 become.

When the gate 12 receives pulse signals PL, PC and PR from the control circuit 1 at a predetermined period, the gate 12 is brought closed, thereby transferring the sensed signals S1, S2 and S3 to the amplifier 13. The sensed signals S1, S2 and S3 are amplified by the amplifier 13 and are converted to digital data M1, M2 and M3 having a predetermined number of bits corresponding to magnitude of the sensed signals S1, S2 and S3 and thereafter are supplied to the register section 15.

The register section 15 comprises three registers **15*a*, 15*b* and 15*c*, in each of which digital data M1, M2 and M3 are stored, respectively. The registers 15*a*, 15*b* and 15*c* of the register section 15 are adapted to receive pulse signals PL, PC and PR. The registers 15*a*, 15*b* and 15*c* in the register section 15 store digital data M1, M2 and M3 respectively every time they receive the pulse signals PL, PC and PR. The digital data M1, M2 and M3 stored respective registers 15*a*, 15*b* and 15*c* in the register section 15 are further output to the peak detection circuit 16 and the vibration-duration detection circuit 17. In this manner, the control circuit 1 applies the pulse signals PL, PC and PR to the gate 12 at a predetermined period, thereby scanning at a predetermined period the sensed signals S1, S2 and S3 output by the sound-plate sensors 11L, 11C and 11R. The scanned sensed signals S1, S2 and S3 are converted to digital data M1, M2 and M3 through the amplifier 13 and the A/D converter 14. The digital data M1, M2 and M3 are stored in the register section 15. The digital data M1, M2 and M3 stored in the register section 15 are supplied directly to the control circuit 1 and also to the peak detection circuit 16 and the vibration-duration detection circuit 17**.

The peak detection circuit 16 serves to detect peak values P1 to P3 of the amplitudes of respective sensed signals S1 to S3 on the basis of the digital data M1 to M3 and to output the detected peak values P1 to P3. The circuit construction of the peak detection circuit 16 will be described in detail later.

The vibration-duration detection circuit 17 serves to detect the vibration durations (the time duration in which the sound plate keep its vibration) of the sensed signal S1 to S3 on the basis of variations of the digital data M1 to M3 and to output the detected vibration durations t1 to t3 to the control circuit 1. The vibration-duration detection circuit 17 also outputs trigger signals T1 to T3 indicating the start and end of vibration of each divided portion of the sound plate 11 to the control circuit 1. When received the trigger signals T1 to T3 indicating the end of vibration, the control circuit 1 applies control signals a1 to a3 to the peak detection circuit 16 and control signals b1 to b3 to the vibration-duration detection circuit 17 and reads in peak values P1 to P3 and vibration durations t1 to t3 from respective circuits. The detailed circuit construction of the vibration-duration detection circuit 17 will be described later.

As described above, when the player of the instrument strikes an arbitrary sound plate 11, the sound-plate sensors 11L, 11C and 11R installed to the struck sound plate 11 output the sensed signals S1 to S3 representing vibration state of each divided portion of the sound plate 11. The control circuit 1 sequentially outputs pulse signals PL, PC and PR to the sound-plate percussion detection section 10, thereby sampling at a predetermined period the sensed signals S1 to S3 output from the sound-plate sensor 11A of each sound plate 11. The peak detection circuit 16 detects peak values P1 to P3 of the vibration amplitude of each divided portion of the sound plate 11 on the basis of the sampling data M1 to M3 of the sensed data S1 to S3. The vibration-duration detection circuit 17 detects vibration durations t1 to t3 of each divided portion of the sound plate 11 on the basis of the sampling data M1 to M3 when the sound plate 11 is struck with the mallet 20L (20R). Further, the vibration-duration detection circuit 17 supplies the trigger signals indicating the start and end of the vibration of each divided portion of the sound plate 11 to the control circuit 1.

Figure 3:
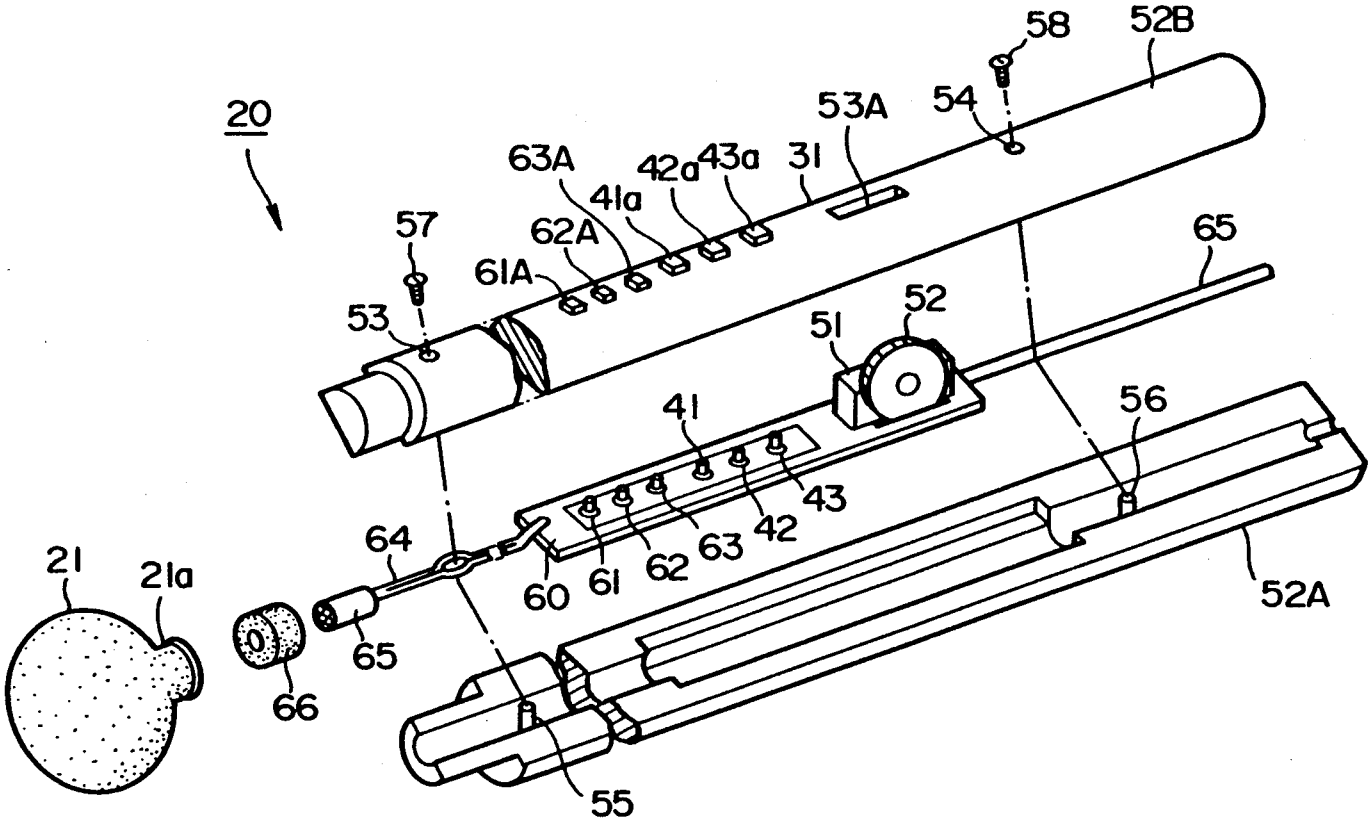
FIG. 3 is a view showing one construction of a mallet.

The mallets 20L and 20R are striking members of a mallet shape, used for striking the sound plate 11. On the mallets 20L and 20R, as will be described in detail later, are provided timbre-selection switches 61 to 63 for selecting timbre and musical-tone control switches 41 to 43, as shown in FIG. 3. When the timbre-selection switches 61 to 63 are operated, timbre-selection data are output to the control circuit 1. The control circuit 1 reads in the timbre selection data at a predetermined period and discriminates the timbre designated by the timbre-selection switches 61 to 63. The control circuit 1 produces timbre data corresponding to the designated timbre and outputs the same to the sound source circuit 4.

A vibration sensor 65 is provided on the mallets 20L and 20R, which sensor senses vibration of mallet portions 21L and 21R of the mallets 20L and 20R, caused when the sound plate 11 and portion other than the sound plate 11, for example, a table surface are struck with the mallets 20L and 20R. The vibration of the mallets portions 21L and 21R is sensed by the vibration sensor 65 and is supplied to the gate 31 as sensed signals S4 and S5.

Furthermore, a gate 31, an amplifier 32, an A/D converter 33, a register section 34, a peak detection circuit 35 and a vibration-duration detection circuit 36 are prepared and these circuits are the same as those having like references in the sound-plate percussion detection section 10. A further description thereof will be omitted. The gate 31 comprises two gates, the register section 34 comprises two registers 34*a* and 34*b*. The digital data M4 and M5 corresponding to the above mentioned sensed signals S4 and S5 are stored in the register section 34.

The control circuit 1 applies sequentially pulse signals PL4 and PL5 to the gate 31 at a predetermined period and thereby scanes at a predetermined period the sensed signals S4 and S5 sensed by the vibration sensors 65 installed in the above mallets 20L and 20R.

When received the pulse signals PL4 and PL5, the gate is brought closed, thereby transmitting the sensed signals S4 and S5 to the amplifier 32. The amplified signals S4 and S5 are supplied to the A/D converter 33. The sensed signals S4 and S5 are converted to digital data M4 and M5 by the A/D converter 33 and thereafter are stored in the register section 34. The digital data M4 and M5 stored in the register section 34 are supplied through a flip-flop circuit 34 to the peak detection circuit 35 and the vibration-duration detection circuit 36.

The peak detection circuit 35 detects peak values of vibrations of the mallet sections 21L and 21R in the mallets 20L and 20R, sensed by the above vibration sensors 65 on the basis of the received digital data M4 and M5. Further, the peak detection circuit 35 outputs the detected peak values P4 and P5 of the vibrations to the control circuit 1.

The vibration-duration detection circuit 36 detects vibration durations t4 and t5 of the vibration of the mallet sections 21L and 21R in the mallets 20L and 20R, sensed by the above vibration sensor on the basis of variations of the input digital data M4 and M5. The detected vibration durations t4 and t5 are supplied to the control circuit 1. The trigger signals T4 and T5 indicating the start and end of vibration of the mallet sections 21L and 21R are also transferred to the control circuit 1.

When received the trigger signals T4 and T5 indicating the end of vibration, the control circuit 1 applies control signals a4 and a5 to the peak detection circuit 35 and control signal b4 and b5 to the vibration duration detection circuit 36, thereby reading in peak values P4 and P5, and vibration durations t4 and t5.

Sound Source Circuit 4

Figure 2:
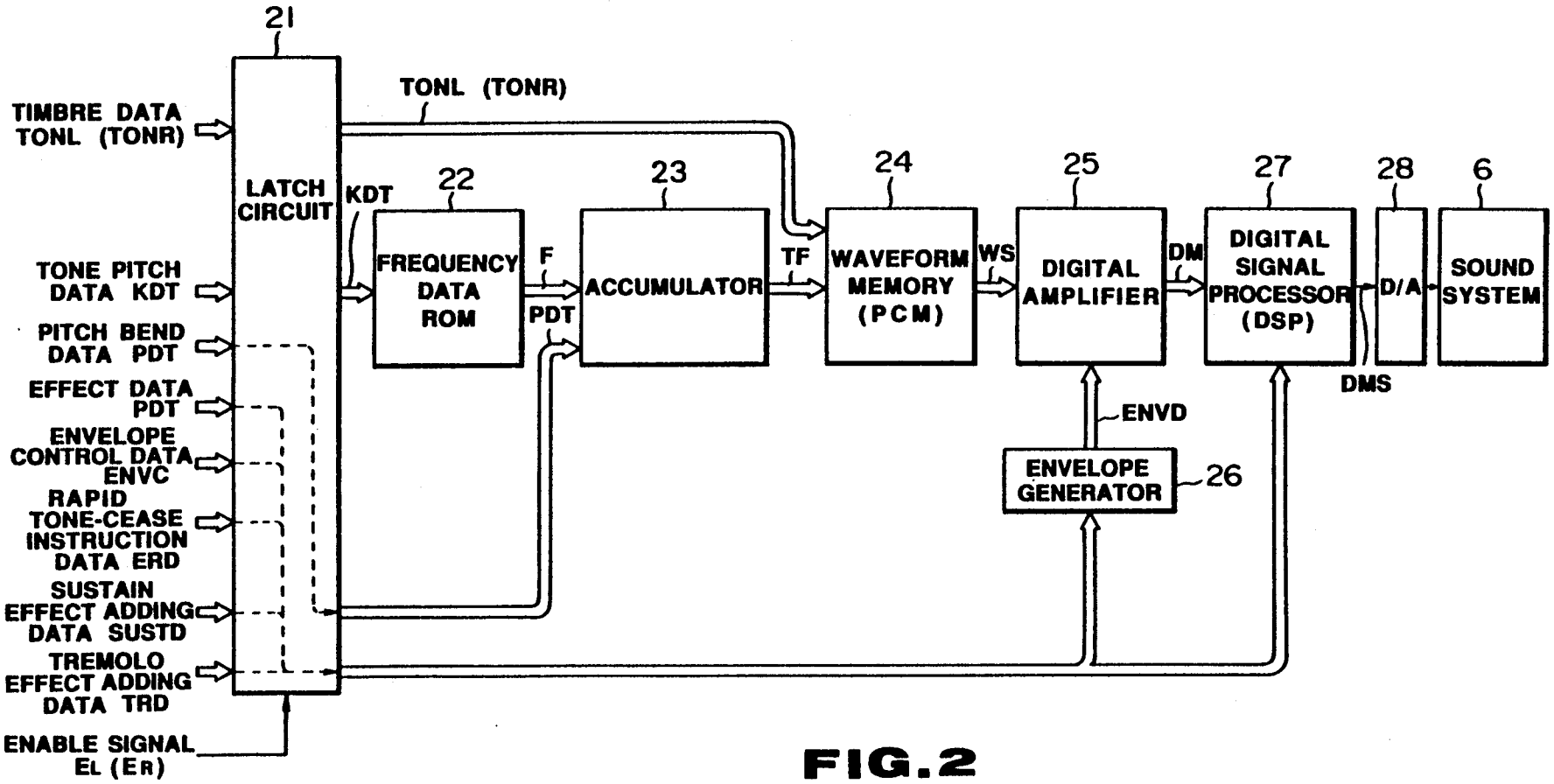
FIG. 2 is a view showing one construction of a sound source circuit.

FIG. 2 is a view illustrating one circuit construction of the sound source circuit 4A for the left hand mallet and the sound source circuit 4B for the right hand mallet. The sound source circuits 4A and 4B comprise a latch circuit 21, a frequency data ROM, an accumulator 23, a waveform memory (PCM) 24, a digital amplifier 25, an envelope generator 26, a digital signal processor (DSP) 27 and a D/A converter 28.

The latch circuit 21 latches timbre data TONL (TONR), tone pitch data(KDT), musical tone control data (MCNTD) (envelope control data ENVC, effect data EFD and the like) supplied from the control circuit 1, every time it receives an enable signal EL (ER) from the control circuit 1. The latch circuit 21 outputs tone pitch data KDT to the frequency data ROM 22, timbre data TL (TR) to the waveform memory 24, envelope control data ENVC to the envelope generator 26, effect control data EFD, rapid tone cease instruction data ERD, sustain effect adding data SUSTD, and tremoro effect adding data TRD to the digital signal processor 27.

The frequency data ROM 22 comprises a Read Only Memory (ROM) storing frequency data corresponding to respective tone pitches. When tone pitch data KTD is applied to the frequency data ROM 22, this ROM 22 outputs frequency data F corresponding to the applied tone pitch data KTD to the accumulator 23. The frequency data is set such that the data F takes larger value as the tone pitch becomes higher.

The accumulator 23 serves to accumulate frequency data F supplied from the frequency data ROM 22. The accumulator 23 accumulates frequency data F until the accumulated frequency data F reaches a predetermined maximum value and repeats the same operation when the accumulated frequency data F reaches the predetermined maximum value. Therefore, as the frequency data F takes a larger value or the musical tone is higher, the repeat-frequency of the operations becomes higher. Inversely, as the musical tone is lower, the repeat-frequency of the operations becomes lower. The repeat-frequency corresponds to the period of the musical-tone waveform. Therefore, as the musical tone becomes higher, the repeat-frequency of the operations or the frequency of musical tones becomes higher. The accumulated value TF of the accumulator 23 is added to the waveform memory as the least-significant address data. The timbre data TONL (TONR) is applied from the latch circuit 21 to the waveform memory 24 as the most-significant address signal.

The waveform memory 24 comprises ROM (Read Only Memory) storing sample data of one period of timbre waveforms of various musical instruments, which sample data are pulse-code modulated. When the waveform memory 24 receives the timbre data TONL (TONR) and the address signal composing of the accumulated value TF output from the accumulator 23, waveform sample data WS of a musical tone waveform of a note having a timbre designated by the timbre data TONL (TONR) is read out from the waveform memory 24 and is applied to the digital amplifier 25. In this case, the operation for reading out the waveform sample data WS from the waveform memory 24 is executed in accordance of the repeat-frequency of the accumulation of the accumulator 23. Therefore, the waveform data supplied to the digital amplifier 25 becomes a tone pitch designated by the tone pitch data KDT.

The digital amplifier 25 serves to multiply the waveform sample data WS supplied from the waveform memory 24 and envelope data ENVD applied from the envelope generator 26, thereby generating a musical-tone wave-form DM having the designated timbre.

The envelope generator 26 serves to apply envelope data ENVD having a predetermined amplitude to the digital amplifier 25 on the basis of the envelope control data ENVC of the latch circuit 21 and control tone volume of a musical tone on the basis of the envelope control data ENVC.

The digital amplifier 25 multiplies sample data WS of a musical tone waveform input from the waveform memory 24 as described above and the amplitude envelope data ENVD applied from the envelope generator 26 to generate a digital musical-tone signal DM and outputs the signal DM to the digital signal processor (DSP) 27. The digital signal processor 27 applies various effects such as reverberation and echo to the digital musical-tone signal DM on the basis of the effect control data EFD supplied from the latch circuit 21 and thereafter outputs the signal DMS to the D/A convertor 28. The D/A converter 28 converts the digital musical-tone signal DMS supplied from the digital signal processor 27 to an analog musical-tone signal AM and output the same to the mixing circuit 10.

The accumulator 23, envelope generator 66 and digital amplifier 25 can execute time-division operation under control of the control circuit 1. The control circuit 1 assigns musical tone data (such as timbre data TOND, tone pitch data KDT, effect data PDT) corresponding to a plurality of striking operations to each channel and causes the latch circuit 21 to latch the musical tone data assigned to each channel at a timing of each channel. The musical tones generated at respective channels in this manner are composed by the digital signal processor 27 and then the composed signal is converted to an analog musical tone signal AM by the D/A converter 28. Therefore, a plurality of sounds can be acoustically output at the same time.

The analog musical tone signal AM is acoustically output as a music through the sound system 6.

Mallet 20

FIG. 3 is an exploded perspective view showing one construction of the mallet 20. A handle portion of the mallet 20 consists of hollow members 52A and 52B which are combined to each other to form a cylinder. The upper half member 52B of the handle portion is provided with tapped through holes 53 and 54 in the vicinities of its front and tail ends. The lower half member 52A is also provided with tapped holes 55 and 56 at portions corresponding to the tapped through holes 53 and 54 formed in the upper half member 51A. The hollow members 52A and 52B are combined by means of screws 57 and 58 screwed through the tapped through holes 53 and 54 to the tapped holes 55 and 56. In a concave room provided at the central portion of the lower half member 52A, a printed circuit board 60 is received. On the printed circuit board 60, three switches 61, 62 and 63 of a push button type are installed for selecting timbres.

The timbre-selection switches 61, 62 and 63 are used to select various timbres such as marimba, piano and guitar timbres. At the portions on the upper half member 52B, corresponding to timbre-selection switches 61, 62 and 63, there are provided cover cases 61A, 62A and 63A for covering the switches 61, 62 and 63. Every time, the cover cases 61A, 62A and 63A are depressed, the switches 61, 62 and 63 are alternatively turned on or turned off.

To the left hand end of the printed circuit board 60, as viewed in FIG. 3, a lead line 64 is connected, and to the right hand end of the printed circuit board 60, a cord 65 is connected. The switches 61, 62 and 63 are electrically connected to the cord 65 through wiring pattern on the printed circuit board 60. When the switches 61, 62 and 63 are turned on by depressing operation, predetermined electric signals are output to the control circuit 1 through the cord 65. The lead 64 forms an eye-ball like space nearly at its center portion in which space a tapped hole portion 55 on the hollow member 52A is received. The other end of the lead 64 is connected to a pressure sensor 65. The front portion of the pressure sensor 65 is received by a recess (not shown) formed in an end portion of a buffer stuff 66 of a cylinder shape. The buffer stuff 66 is adapted to be pressed into a receiving portion 21*a* of the mallet portion 21. The pressure sensor 65 is received in the hollow member 52. The mallet portion 21 is combined with the handle portion by means of the buffer stuff 66.

When the mallet portion 21 is struck, the vibration of the mallet portion 21 is weaken by the buffer stuff 66 and transferred to the pressure sensor 65. The pressure sensor 65 outputs a sensed signal expressing the vibration of the mallet portion 21. The sensed signal is conveyed to the control circuit 1 through the lead line 64, the printed circuit board 60 and the cord 65. The amplitude of the sensed signal is proportional to the strength of the striking the mallet portion 21.

As the timbre selection switches 60, 61 and 62 are disposed at positions where the player of the mallet 5L (5R) are allowed to easily operate them, the player can switch the timbre by simple operation during playing operation.

On the printed circuit board 60, a variable resistor or a rheostat 51 is mounted. A pitch-bend operating member 52 of a wheel shape is fixed to the side face of the rheostat 51 for controlling the resistance value. The rheostat 51 is arranged on the circuit board 60, such that the upper portion of the pitch-bend operating member 52 is exposed through a hole 53A formed in the hollow member 52B. The pitch-bend operating member 52 is rotatable and the resistance value of the rheostat is changed depending on the rotating direction and rotating angle of the pitch-bend operating member 52. The pitch-bend operating member 52 has a notched peripheral surface for easy operation with a finger.

Variation of resistance value of the rheostat 51 is converted to a relavant voltage, which is supplied through the cord 65 to the control circuit 1.

The control circuit 1 reads in the above voltage at a predetermined period to generate pitch-bend data PDT for controlling a tone-pitch of a musical tone. The control circuit 1 outputs the pitch-bend data PDT to the sound source circuit 4A for the left hand mallet or the sound source circuit 4B for the right hand mallet depending on the mallet, the pitch-bend operating member is operated.

The switches 41, 42 and 43 mounted on the printed circuit board 60 serves to apply sustain effect, rapid tone cease instruction and tremolo effect, respectively. More specifically, the switch 41 serves to instruct to apply sustain effect to a musical tone being generated, the switch 43 serves to instruct to apply tremolo effect to a musical tone being generated and the switch 42 serves to instruct to rapidly cease sound of a musical tone being generated.

When the above switches 41, 42 and 43 are turned on, on-operation signals are delivered from the switches 41, 42 and 43 to the control circuit 1. When the control circuit 1 receives on-operation signal of the above switches 41, 42 and 43, the circuit 1 produces the sustain effect adding data SUSTD, the rapid tone-cease instruction data ERD and the tremolo effect adding data TRD in accordance with the instructions of the above respective switches and supplies these data to the sound source circuit 48A or 48B corresponding to switch operated mallet 20L (20R).

Sound Plate 11 (Sound Plate Sensor 11A)

Figure 4:
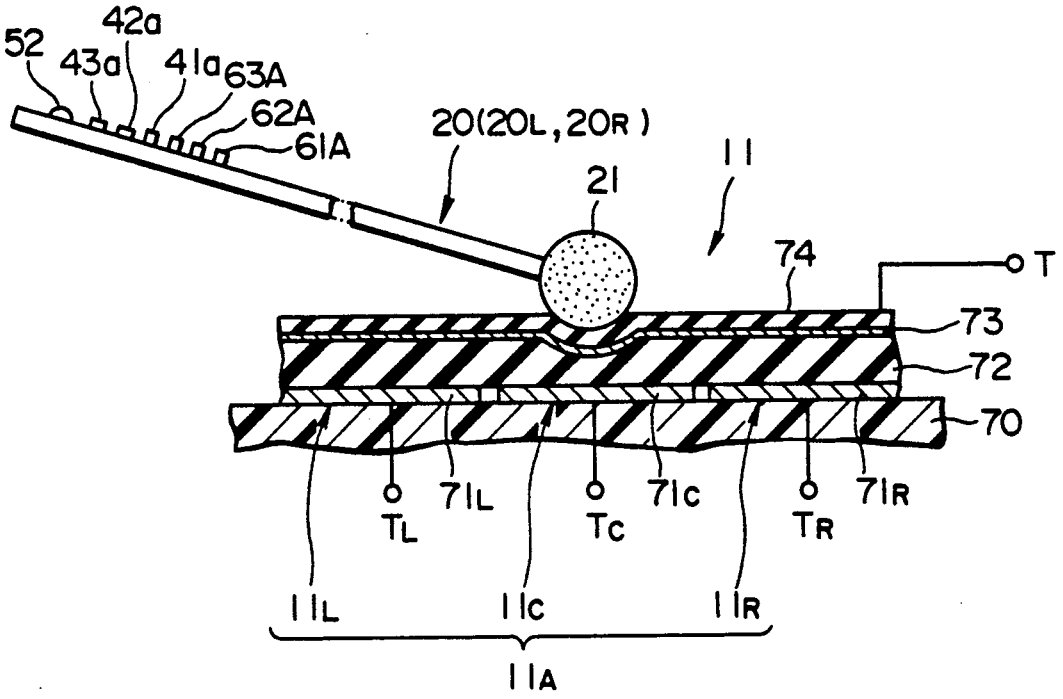
FIG. 4 is a view showing one construction of a sound plate composing a member to be struck.

FIG. 4 is a sectional view showing one construction of a sound plate 11. In this construction, the sound plate 11 and a sound plate sensor 11A are combined in one unit.

The sound plate 11 is of a laminate construction. The laminate construction consists of an insulating base plate 70, three under electrode members 71L, 71C and 71R separately and in parallel stacked on the above insulating base plate 70, an elastic conductive member 72 formed on the upper surfaces of the above under electrode members 71L, 71C and 71R, an upper electrode member 73 provided on the upper surface of the above elastic conductive member 72 and an insulating facing member 74 laminated on the upper electrode member 73. The elastic conductive member 72 consists of, for example, conductive rubber foam (resistivity, approximately 1 to 10ω cm). The upper electrode member 72 consists of, for example, rubber of high conductivity (resistivity, approximately $10^{-2}$ωcm). The facing member 74 consists of, for example insulating rubber and may be formed integrally with the facing member of other sound plate 11.

A terminal T is connected to the upper electrode member 73 and terminals TL, TC and TR are connected to the under electrode members 71L, 71C and 71R, respectively. Resistances RL, RC and RR are provided between the terminal T and the terminals TL, TC and TR, respectively.

The sound plate sensor 11L is composed of the upper electrode member 73, the elastic conductive member 72 and the under electrode member 71L, and similarly the sound plate sensors 11C and 11R are composed of the upper electrode member 73, the elastic conductive member 72 and the under electrode members 71C and 71R, respectively. That is, the sound plate sensor 11A comprises three sound plate sensors 11L, 11C and 11R for sensing vibration of three-divided portions of the sound plate.

When the surface of the sound plate 11 is struck with the mallet portion 21L of the mallet 20L (20R), distances between the upper pelectrode member 73 and the under electrode members 71L, 71C and 71R decrease. As a result, the resistivity of the elastic conductive member 72 is reduced. Therefore, resistance of resistors RL, RC and RR of the sound plate sensors 11L, 11C and 11R are also reduced. Resistance variation of resistors RL, RC and RR of the sound plate sensor 11A becomes maximum, when the portion on the sound plate 11 closest to them is struck. In this manner, the sound plate sensors 11L, 11C and 11R sense the intensity of striking operation in terms of variations of resistances RL, RC and RR. The variations of resistances RL, RC and RR of the sound plate sensors 11L, 11C and 11R are converted to electric signals and supplied to the gate 12. That is, electric signals representing vibrations of respective portions of the sound plate 11 are output from the sound plate sensors 11L, 11C and 11R.

In this manner, since vibrations of respective portions of the sound plate 11 can be independently sensed, the striking operation can be detected without failure regardless of the struck position.

Peak Detection Circuit

Figure 5:
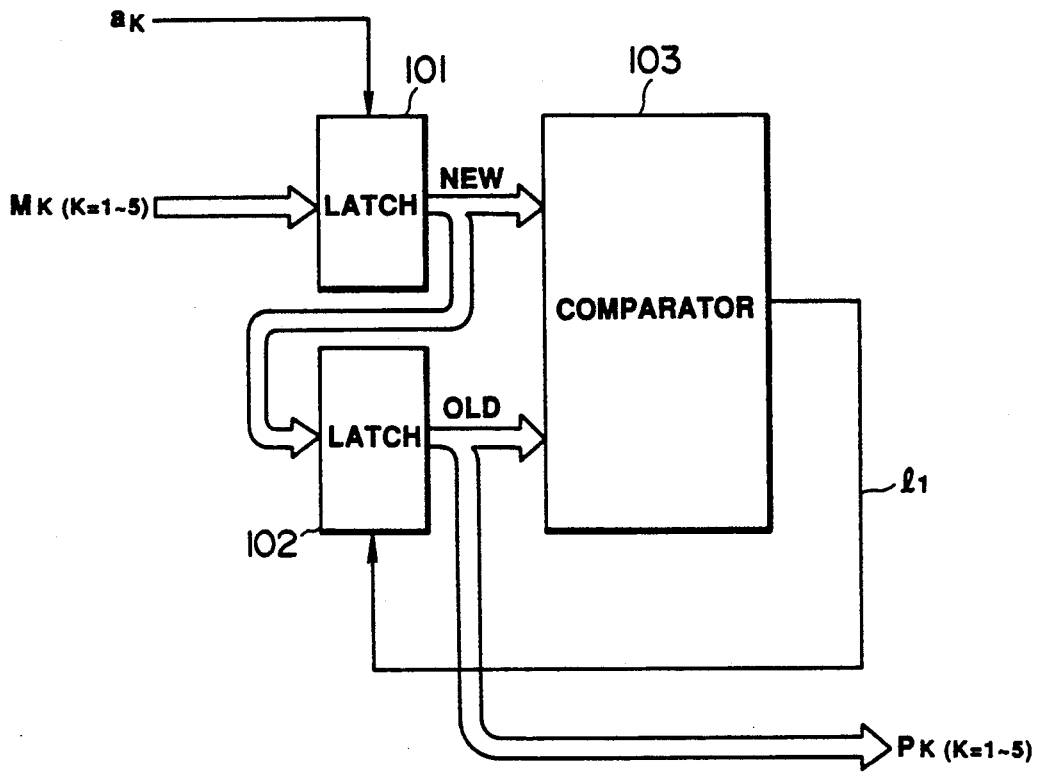
FIG. 5 is a view showing one construction of a peak detection circuit.

FIG. 5 is a circuit diagram showing one circuit construction of peak detection circuits 16 and 35. In practice, in the peak detection circuits 16 and 35 shown in FIG. 1, there are provided in parallel the same number of the peak detection circuits as shown in FIG. 5 as the input number of the digital data MK (K=1 to 5).

A circuit for detecting peak values PK of digital data KK comprises a latch circuit 101 for latching digital data MK, a latch circuit 102 for latching outputs of the latch circuit 101 and a comparator 103 for comparing outputs of the latch circuits 101 and 102.

When received a latch signal aK from the control circuit 1 shown in FIG. 1, the latch circuit 101 latches digital data MK supplied from the latch circuit 15. For example, the latch signal aK is applied to the latch circuit 101 after a predetermined time delay after generation of pulses P (pulses PL, PC, PR, PL4 and PL5 are collectively referred to as pulses P). More specifically, the sensed signal SK passes through the gate 12 (31) to which the pulses P are applied and is converted to digital data MK by the A/D converter 14 (33), and thereafter the latch signal aK is applied to the latch circuit 101. As a result, the latest digital data MK of the scanned sensed-signal SK of the sound plate sensor 11A (or a pressure sensor element 65) is latched in the latch circuit 101. For convenience, the digital data latched in the latch circuit 101 is represented by "NEW". At first, the latch circuit 102 is set to the initial value "0" and the outputs of the latch circuits 101 and 102 are applied to the comparator 103. Again, for convenience, latched data of the latch circuit is represented by "OLD".

The comparator 103 compares the output NEW of the latch circuit 101 and the output OLD of the latch circuit 102. If NEW is larger than OLD, the comparator 103 generates the output "1". If NEW is equal to or smaller than OLD, the comparator generates the output "0". The output of the comparator 103 is applied to the latch circuit 102 as a latch signal $l_1$. The latch circuit 102 latches the output NEW of the latch circuit 101 at the trailing edge of the latch signal $l_1$ ("1" "0"). Therefore, the maximum value among the digital data MK to be input to the peak detection circuit 16 is latched in the latch circuit 102.

Figure 7:
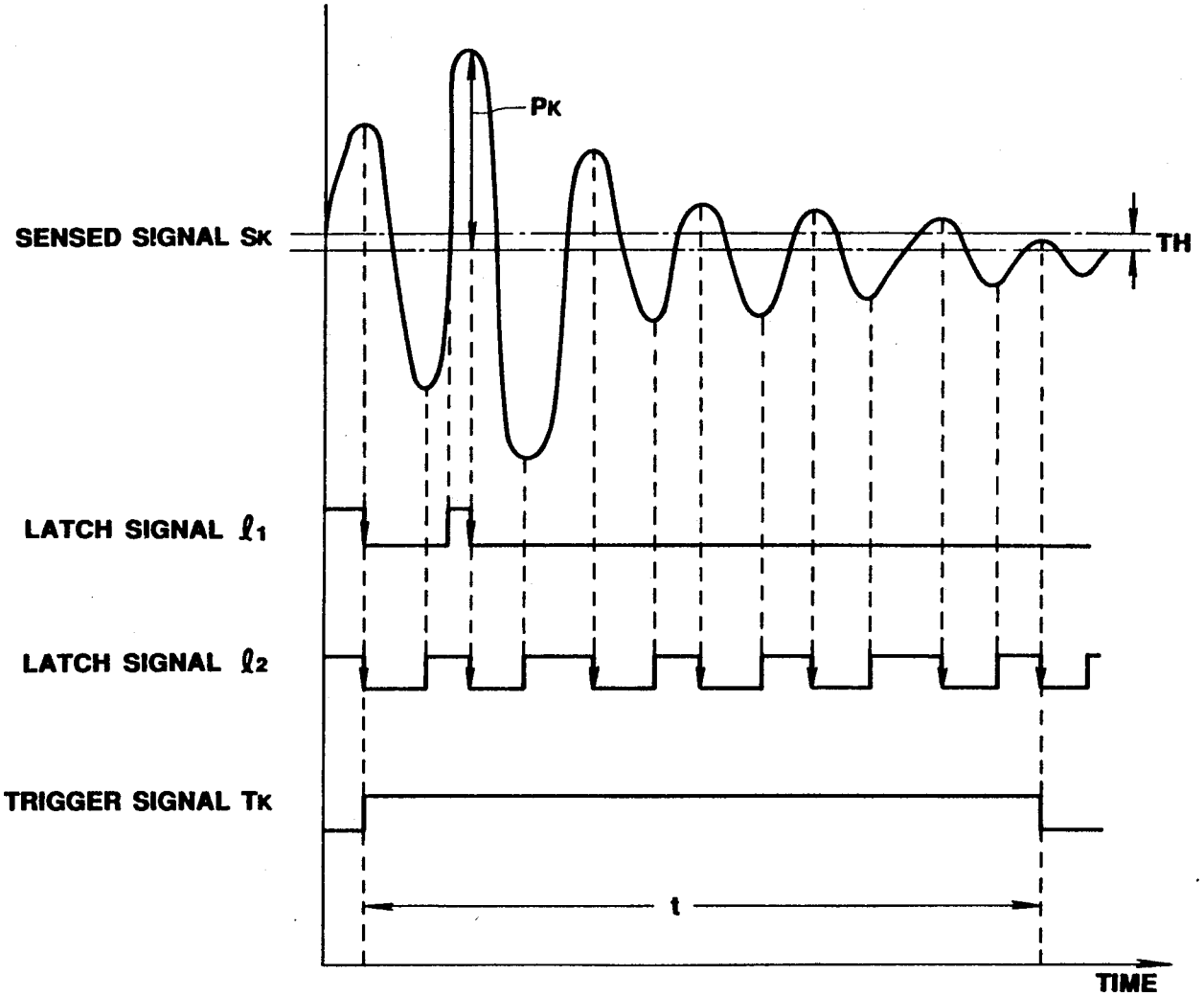
FIG. 7 is a timing chart for explaining operations of the peak detection circuit and the vibration duration detection circuit.

For example, when the sensed signal SK as shown in FIG. 7 is sensed by the sound plate sensor (or a pressure sensor element 65), the digital data MK is input to the peak detection circuit 16, which digital data MK corresponds to the sensed signal SK sampled at the period of the pulse signal PK which is applied to the gate 12 (31). When the peak value PK of the sensed signal SK shown in FIG. 7 is latched in the latch circuit 101, the latch signal $l_1$ is applied from the comparator 103 to the latch circuit 102 and the peak value PK is latched in the latch circuit 102. Since the sensed signal SK is gradually decreased thereafter, the digital data Mi to be sampled by no means becomes larger than the above peak value PK. Therefore, the latch circuit 102 holds the peak value PK. The control circuit 1 detects the end of the vibration of the sound plate 11, when the vibration-duration detection circuit 17 as will be described in detail later, output a trigger signal indicating the end of the vibration. Then the control circuit 1 fetches the peak value PK latched in the latch circuit 102.

Vibration-Duration Detection Circuits 17 and 36

Figure 6:
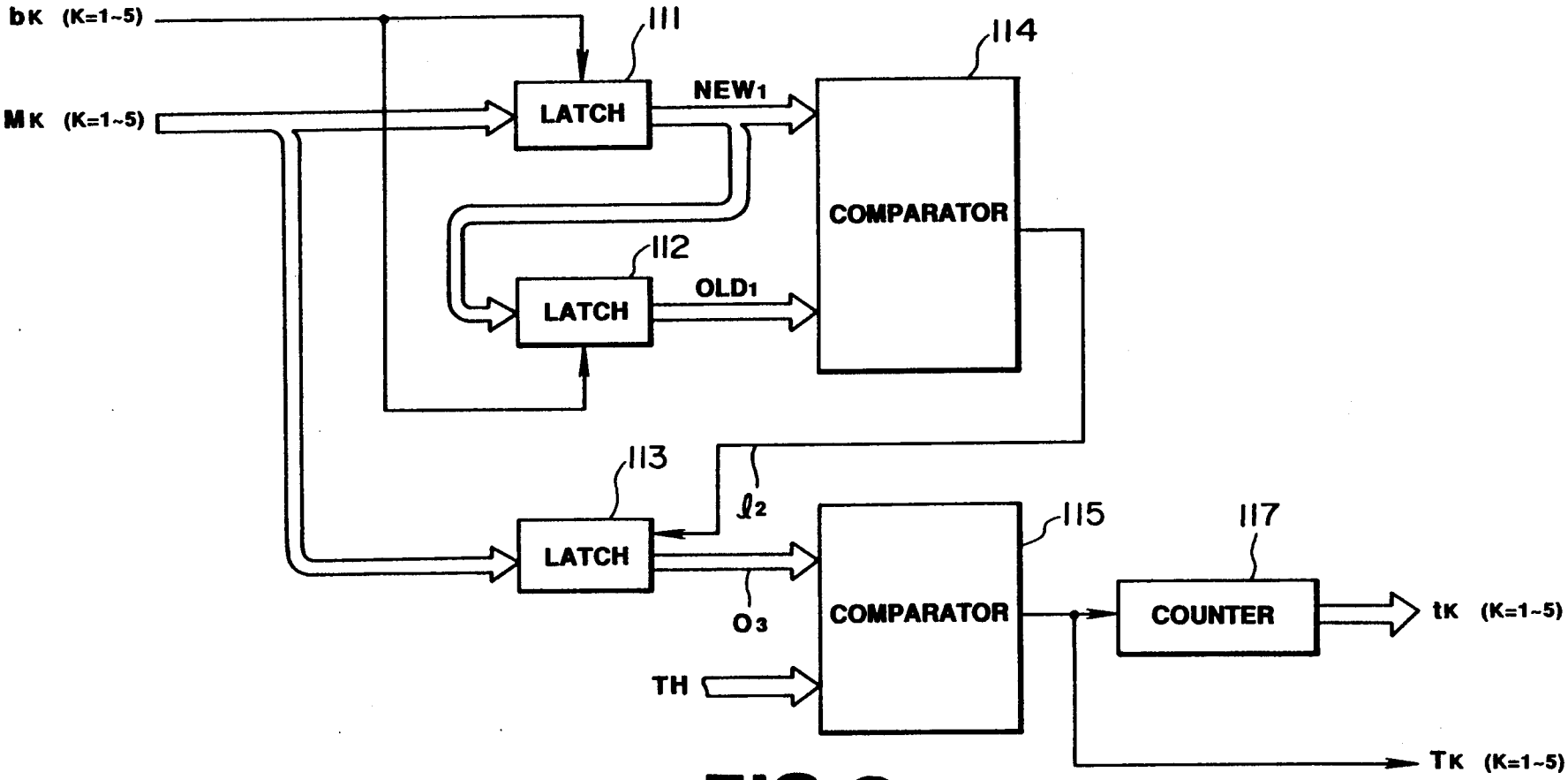
FIG. 6 is a view showing one construction of a vibration-duration detection circuit.

FIG. 6 is a view showing one construction of the vibration-duration detection circuits 17 and 36 shown in FIG. 1.

Actually, in the vibration-duration detection circuits 17 and 36, there are provided in parallel the same number of vibration-duration detection circuits shown in FIG. 6 as the input number of digital data MK.

A circuit for detecting vibration duration on the basis of the digital data MK comprises latch circuits 111 and 113 for latching the digital data MK, a latch circuit 112 for latching the output of the latch circuit 111, a comparator for comparing outputs of the latch circuits 111 and 112, a comparator 114 for comparing the output of the latch circuit 113 and a predetermined threshold value TH and a counter 117 to which the output of the comparator 114 is applied. Receiving a latch signal bK from the control circuit 1, the latch circuit 111 latches the digital data MK. Receiving a latch signal bK, the latch circuit 112 latches the output (for convenience, the output is referred to as NEW 1) of the latch circuit 111. Therefore, the latch circuit 111 retains the latest (present) digital data MK and the latch circuit 112 retains the preceding digital data MK. The comparator 114 compares the output (the present digital data MK) of the latch circuit 111 and the output (the preceding digital data MK) of the latch circuit 112. If the present digital data MK is larger than the preceding digital data MK (NEWi>OLDi), the comparator 114 generates the output $l_2$ "1", and if the present digital data Mi is equal to or smaller than the preceding digital data Mi (NEWi≦OLDi), the comparator 114 generate the output $l_2$ "0".

In case that the sensed signal SK (amplified by the amplifier 13 or 32) has such a waveform as shown in FIG. 7 and the threshold value TH is set at such a value as shown in FIG. 7, a latch signal $l_2$ output from the comparator 114 is a pulse signal as shown in FIG. 7 and is applied to the latch circuit 113.

The latch signal $l_2$ drops abruptly from a high level "1" to a low level "0" at the time the sensed signal Si turns from the positive peak value towards the negative peak value and rises abruptly from a low level "0" to a high level "1" at the time the sensed signal Si turns from the negative peak value towards the positive peak value.

The latch circuit 113 latches the digital data MK output from the register 15 (or 34) shown in FIG. 1 at the trailing edge of the latch signal $l_2$. The comparator 115 compares the output $0_3$ of the latch circuit 113 and the threshold value TH. When the output $0_3$ of the latch circuit 113 is larger than the threshold value TH, the comparator 115 outputs a signal "1". When the output $0_3$ of the latch circuit 113 is equal to or smaller than the threshold value TH, the comparator 115 outputs a signal "0". Therefore, the output C of the comparator 115 retains a value "1" while the peak values, at every period, of the sensed signal SK latched in the latch circuit 113 are larger than the threshold value TH, as shown in FIG. 7. As a result, the trigger signal TK output from the comparator 115 retains a high level "1" until the sensed signal Si decreases to be equal to or less than a predetermined value. The trigger signal TK is supplied to the counter 117 and the control circuit 1. A clock signal (not shown) having a predetermined frequency is input from the timer 2 of FIG. 1 to the counter 117. The counter 117 counts the number of clock pulses input thereto while the enable signal (trigger signal) TK applied from the comparator 115 retains a level "1". That is, the counter 117 counts the number of pulses which is proportional to the vibration duration tK of the sensed signal SK, as shown in FIG. 7. If the period of the clock signal is set at a predetermined time unit, for example, 1 msec, the count value is equal to the vibration duration tK itself.

The control circuit 1 detects the start of the vibration of the sound plate 11 or the mallet portion 21L (21R) when the trigger signal TK input thereto from the vibration-duration detection circuit 17 (36) rises from a level "0" to a level "1". Further, the control circuit 1 detects the start of the vibration of the sound plate 11 or the mallet portion 21L (21R), when the trigger signal TK drops from a level "1" to a level "0". And also the control circuit 1 detects the end of the vibration of the sound plate 11 or the mallet portion 21L (21R) when the trigger signal TK drops from a level "1" to a level "0". That is, the control circuit detects the percussion of the sound plate 11 or the mallet 20 at the leading edge of the trigger signal TK and detects the end of vibration of the sound plate 11 or the mallet portion 21L (21R) at the trailing edge of the trigger signal TK.

Now, the operations of the present embodiment in various modes will be described.

Normal Mode

The mode selection switch is brought to a normal mode position to set a normal mode.

As described above, when a certain sound plate 11 is struck with the mallet 20L (20R) in the normal mode, the vibration-duration detection circuit 16 of the sound-plate percussion detection section 10 corresponding to the struck sound plate 11 applies the trigger signal Ti (i=1, 2) indicating the start of the vibration of the sound plate 11 to the control circuit 1.

When received the trigger signal Ti indicating the start of the vibration of the sound plate 11, the control circuit 1 outputs to the sound source circuit 4 tone pitch data corresponding to the sound plate 11 connected to the sound-plate percussion detection section 10 which has output the above trigger signal Ti. Further, the control circuit 1 reads out at a certain period digital data M1 to M3 stored in the register section 15 of the sound-plate percussion detection section 10 which has output the trigger signal Ti, and produces envelope control data and effect control data such as echo and reverberation effects and then outputs these data to the sound source circuit 4. Since the trigger signal Tj (j=4, 5) indicating the start of the vibration of the mallet portion is applied to the control circuit 1 from the vibration-duration detection circuit 36 corresponding to the struck mallet 20 almost at the same time that the trigger signal Ti is supplied thereto, the control circuit 1 reads out the timbre selection data output from the timbre selection switches 61 to 63 of the struck mallet 20 and outputs the designated timbre data to the sound source circuit 4. Thereby, the sound source circuit 4 generates a musical tone which has a tone pitch corresponding to the struck sound plate 11 and also has a timbre selected by the timbre selection switches 61 to 63 of the struck mallet 20L (20R). The musical tone generated by the sound source circuit 4 is sounded through the sound system 6.

Now, referring to FIGS. 9A through 9D, control operation of musical tones will be described which is executed when the switches 41 to 43 provided on the mallet 20L (20R) are operated right after the sound plate 11 is struck with the above mallet 20L (20R). Note that in FIGS. 9A through 9D, an amplitude envelope of a musical tone is indicated in a solid line 70 when no musical tone control is executed.

When a particular sound plate 11 is struck with the mallet 20L (20R), tone pitch data corresponding to the above sound plate 11 is supplied to the sound source circuit 4 in response to the striking operation. Then, a musical tone having a tone pitch corresponding to the above tone pitch data is generated. During generation of the musical tone, the pitch-bend operating member 52 is turned. Then pitch bend data PDT corresponding to the above turning operation is supplied from the control circuit 1 to the latch circuit 21 (FIG. 2).

The pitch bend data PDT latched in the latch circuit 21 is output to the accumulator 63. The accumulator 63 executes an accumulation-operation to obtain "F+PDT" by adding pitch bend data PDT to frequency data F applied from the frequency-data ROM 22. The control circuit 1 scans at a predetermined period voltage value expressing the resistance variation of the variable resistor 51 which is caused by the turning operation of the pitch-bend operating member 52. Further, the control circuit 1 outputs to the latch circuit 21 pitch-bend data PDT corresponding to the above voltage together with enable signal EL (ER) every time the above voltage is varied.

Figure 9A:
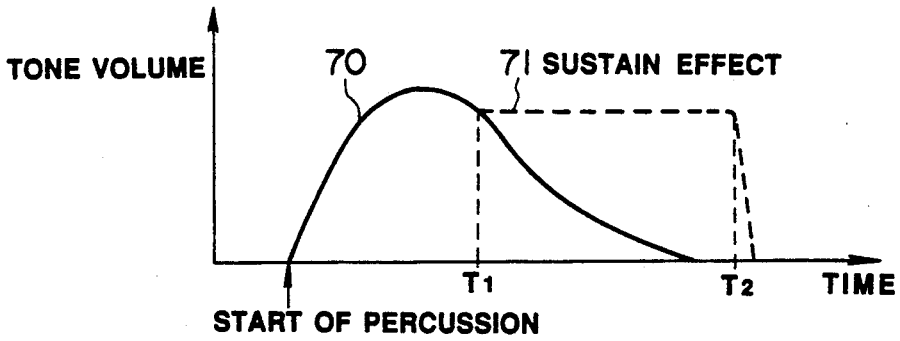
FIGS. 9A to 9D are views for explaining control operation for musical tone parameters.
Figure 9B:
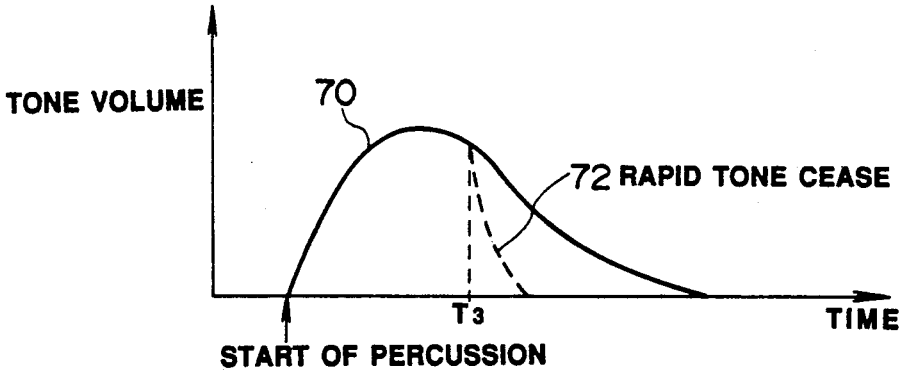
Figure 9C:
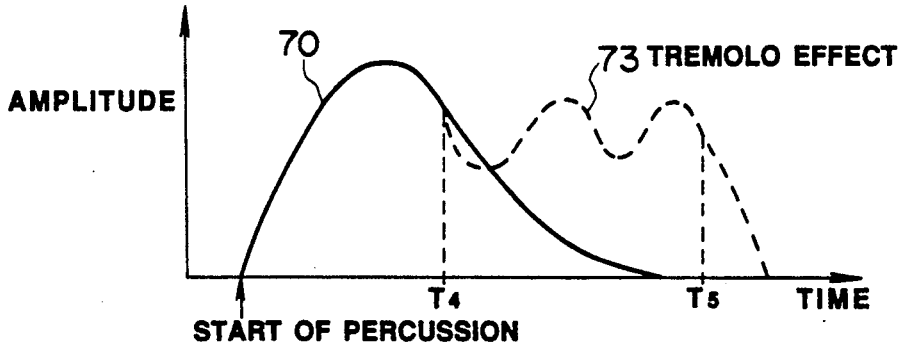
Figure 9D:
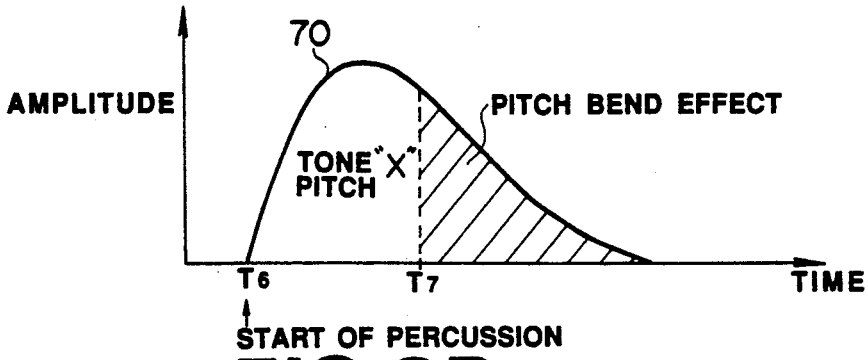

As shown in FIG. 9D, when the sound plate corresponding to a tone pitch "x" (symbol x denotes an arbitrary tone pitch) is struck with the mallet 20L (20R) at the time T6 and thereafter the pitch-bend operating member 52 is turned at the time T7, the musical tone of a tone pitch X is changed in its pitch in response to the turning operation of the pitch-bend operating member 52 after the time T7 (Pitch Bend).

When the switch 41 provided on the mallet 20L (20R) is operated, sustain effect adding data SUSTD is input to the latch circuit 21. The sustain effect adding data SUSTD latched in the latch circuit 21 is output to the envelope generator 66. When the sustain effect adding data SUSTD is applied, the envelope generator 66 thereafter keeps supplying to the digital amplifier 25 the envelope data which is output at the time the sustain effect adding data SUSTD is applied thereto.

Accordingly, when the switch 41 is turned on to add the sustain effect at the time T1 in FIG. 9A the musical tone holds its tone volume at the level determined at the time T1 as indicated in a broken line in FIG. 9A until the switch 41 is turned off at the time T2 (Sustain).

When the switch 42 provided on the mallet 20L (20R) is operated, rapid tone-cease instruction data ERD is input to the latch circuit 21. The rapid tone-cease instruction data ERD latched in the latch circuit 21 is output to the envelope generator 66. When the rapid tone-cease instruction data ERD is applied, the envelope generator 66 controls the envelope data ENVD to be supplied to the digital amplifier 25 so as to cause the amplitude envelope of the musical tone to rapidly reduce.

Accordingly as shown in FIG. 9B, when the switch 42 is turned on at the time T3 to generate the rapid tone-cease instruction data, the tone volume of the musical tone reduces rapidly as indicated in a broken line in FIG. 9B (Rapid Tone Cease).

When the switch 43 provided on the mallet 20L (20R) is operated, tremolo effect adding data TRD is input to the latch circuit 21. The tremolo effect adding data TRD latched in the latch circuit 21 is output to the envelope generator 66. When the tremolo effect adding data TRD is applied, the envelope generator 66 controls the envelope data ENVD to be supplied to the digital amplifier 25 so as to cause the tone volume of the musical tone to increase and decrease by a somewhat small amount.

Accordingly, when the tremolo effect switch 43 is operated at the time T4 as shown in FIG. 9C, the tone volume of the musical tone fluctuates as indicated in a broken line 73 in FIG. 3 until the switch is operated at the time T5 (TremoloEffect).

In the manner described above, after a certain sound plate 11 is struck with the mallet 20L (20R) to generatea musical tone 70 having a tone pitch corresponding to the struck sound plate 11, tremolo effect, pitch bend effect and sustain effect can be applied to the musical tone 70 which is being generated or sounding of the musical tone 70 can be stopped by operations of the switches 41 to 43 provided on the mallet 20L (20R) or the pitch-bend operating member 52.

Recording Mode

In the recording mode, a musical tone having a certain timbre is sounded in real time as described above, and percussion data of the sound data and percussion data of the mallet 20 are recorded in the sequencer RAM 7.

Now, referring to the internal construction of the sequencer RAM 7 shown in FIG. 8, the recording operation of the control circuit 1 will be described which is executed in the recording mode to record the percussion data of the sound plate 11 and the mallet 20.

When the trigger signal Tj (j=4, 5) indicating the start of the vibration is supplied from the vibration-duration detection circuit 36, the control circuit 1 reads out the counted present time and writes the present time in an operation (percussion) time area of the sequencer RAM 7.

Note that the percussion time may be the time when the trigger signal Ti (i=1 to 3) indicating the start of the vibration is applied from the vibration-duration detection circuit 17 of the sound plate percussion detection section 10 to the control circuit 1.

Further, the control circuit 1 reads in switch-operation data of the timbre selection switches 61 to 63 of the mallet 20L (20R) which outputs the above trigger signal Tj and judges the designated timbre based on the switch operation data. Then, the control circuit 1 writes the timbre data corresponding to the designates timbre in a timbre-selection data storing area 43C of a mallet data area 43 in the sequencer RAM 7, which corresponds to the struck mallet 20.

The control circuit 1 watches the trigger signal Tj output from the vibration-duration detection circuit 36 and receives the peak value Pj from the peak detection circuit 35 when the trigger signal Tj indicating the end of the vibration is applied thereto. Then the control circuit 1 writes the peak value Pj corresponding to the struck mallet 20 in a vibration level storing area 43*a* of the mallet data area 43 in the sequencer RAM 7, as shown in FIG. 8. In FIG. 8, the peak values written in the vibration level storing area 43*a* are expressed by "HIGH", "MEDIUM", but actually the peak values Pj are written instead of the above expression. Expressions "HIGH", "MEDIUM" represent the relative levels of the peak values.

Furthermore, the control circuit 1 reads out the vibration duration tj corresponding to the struck mallet from the vibration-duration detection circuit 17 and writes the same in a vibration duration storing area 43*b* of the mallet data area 43.

The control circuit 1 reads out peak values P1 to P3 from the peak detection circuit 16 corresponding to the struck sound plate 11 and vibration durations t1 to t3 from the vibration duration detection circuit 17 and writes these data in the vibration level storing area 41*b* and the vibration duration storing area 41C of the sound plate data area 41 in the sequencer RAM 7, respectively. The control circuit 1 writes tone pitch data corresponding to the struck sound plate 11 in the tone-pitch storing area 41*a* of the sound plate area 41.

Figure 8:
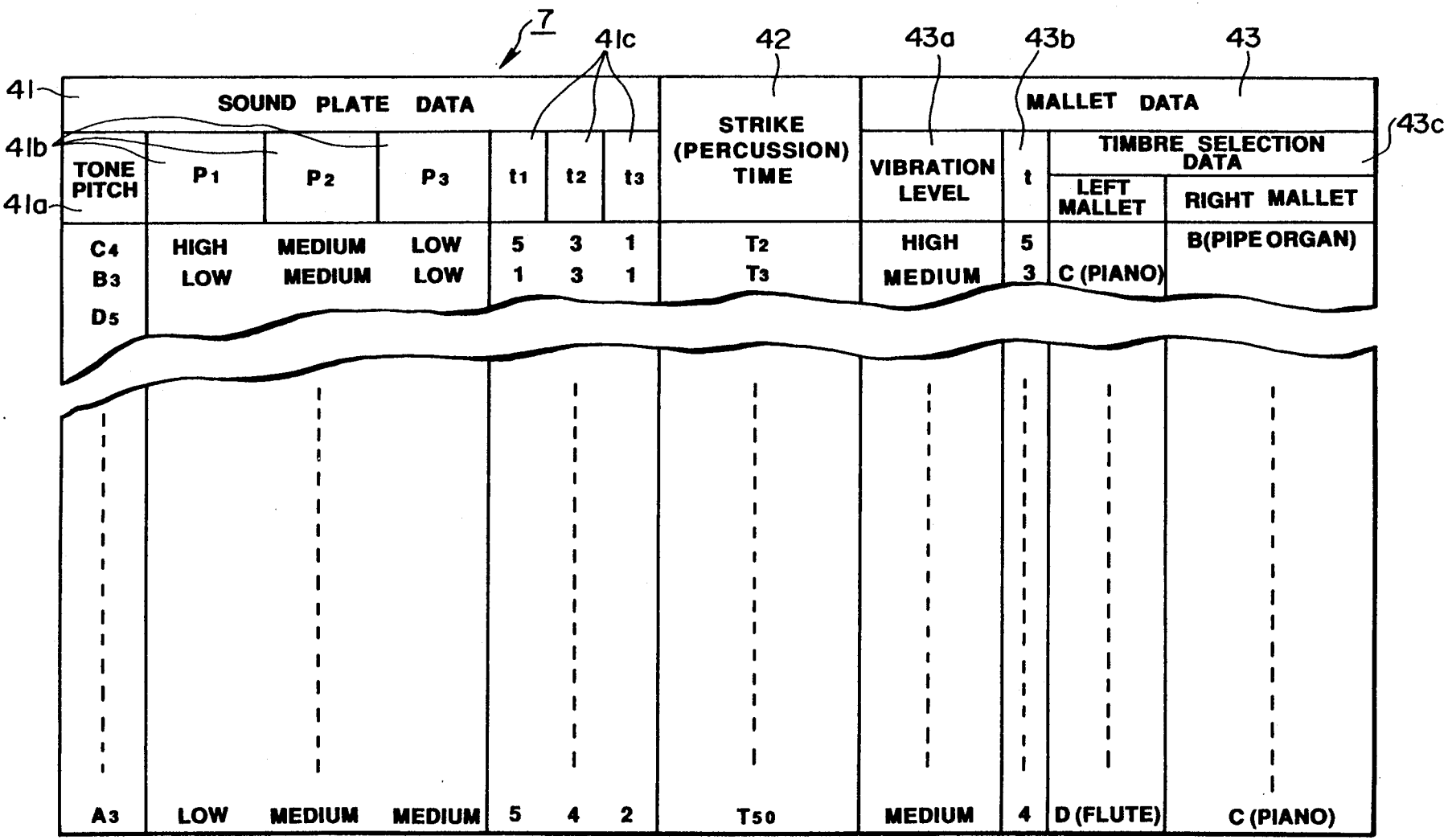
FIG. 8 is a view showing a memory state in a sequencer RAM.

Thereafter, in the recording mode, in the similar manner, the sound plate data concerning the percussion operation, the mallet data concerning the operation (percussion) times, percussion operation are sequentially written in the sequence RAM 7, every time the sound plate 11 is struck with the mallet 20, as shown in FIG. 8.

Play Back Mode

The mode selection switch 3 is operated to select the play back mode. Then the control circuit 1 reads out sequentially sound plate data 41, operation (percussion) times 42, mallet data 43 to produce tone pitch data, envelope control data and effect control data. Then, the control circuit 1 supplies the above tone pitch data, envelope control data and the effect control data to the sound source circuit 4 at a predetermined time interval on the basis of the operation (percussion) times, and thereby a recorded melody and the like are reproduced at the same performance tempo as that in the recording mode.

Method of Setting Musical Tone Data

Now, methods of setting tone pitch data, tone volume data, envelope control data and effect control data will be described which the control circuit 1 employs.

At first, the method of setting tone pitch data will be described. As described above, the control circuit 1, scans the sensed signals S1, S2 and S3 sensed by the sound-plate sensors 11L, 11C and 11R at a predetermined period, while the control circuit 1 outputs pulse signals PR, PC and PL. Mean while, when the sound plate 11 is struck with the mallet 20, the trigger signal Tj indicating the start of the vibration is applied to the control circuit 1 from the vibration-duration detection circuit 17 of the sound-plate percussion detection section 10 corresponding to the struck sound plate 11.

The control circuit 1 finds the struck sound plate 11 by judging which sound-plate percussion detection section 10 has output the above trigger signal Tj to the control circuit 1. Then, the control circuit 1 sets the tone pitch data corresponding to the above sound plate 11 with reference to, for example, a tone-pitch convertion table stored in RAM (not shown).

The envelop control data will be set as follows. The control circuit 1 reads out peak valves P1, P2 and P3 from the peak detection circuit 16 of the sound-plate percussion detection section 10, when it receives the trigger signal Tj indicating the end of the vibration from the vibration duration detection circuit 17. Then the control circuit 1 set the tone volume based on the above peak values P1 to P3.

The tone volume is set in accordance with the maximum value Max (P) among peak values P1 to P3. That is, the tone volume is set at a relatively low level for a relatively low value of Max (P) and is set at a relatively high level for a relatively high value of Max (P). In this manner, the tone volume is set in proportion to the value of Max (P). In other way, the tone volume can be set in proportion to SUM (P); the sum of peak values P1 to P3. In yet another way, certain tone volume is previously determined for each of divided portions of the sound plate and the tone volume may be set on the basis of the previously determined tone volume for the divided portion for which the peak value Pi (i=1 to 3) is maximum.

As described above, when the trigger signals T1 to T3 indicating the end of the vibration from the vibration duration detection circuit 17, the control circuit reads out the vibration durations t1 to t3 from the vibration duration detection circuit 17. Then, the control circuit 1 sets the envelope control data to control the tone volume of a musical tone and the waveform of a musical-tone envelope on the basis of the above tone volume data and the vibration durations t1 to t3 of respective divided portions of the sound plate 11.

Effect control data for echo effect, reverberation effect and the like are set when the peak value Pi of a certain divided portion of the sound plate 11 exceeds a predetermined value.

The tone pitch data, timbre data, envelope control data and effect control data set in the above-mentioned manner are output from the control circuit 1 to the sound source circuit 4.

The sound source circuit 4 generates a musical tone designated by the above timbre data, tone pitch data and envelope control data, to which musical tone the effect designated by the above effect control data and supplies the musical tone to the sound system 6. The sound system 6 outputs sound of the musical tone generated by the sound source circuit 4.

The tone volume of the musical tone varies in accordance with the percussion intensity to the sound plate 11. Therefore, the percussion intensity of the mallet 20 can delicately change the tone volume of the musical tone. The selection of the striking position on the sound plate 11 can apply effects such as echo effect, reverberation effect and the like to the musical tone.

When a body other than the sound plate 11 is struck with the mallet 20, the peak values P4 and P5 of the vibration of the mallet portion 21 are input through the peak detection circuit 35 to the control circuit 1. The vibration durations t4 and t5 of the mallet portion 21 are also input through the vibration-duration detection circuit 36 to the control circuit 1. In this case, the control circuit 1 sets a certain rhythm sound on the basis of the operation data of the timbre selection switches 61 to 63 provided on the struck mallet 20 and also sets tone volume data of the above rhythm sound on the basis of the peak values P4 and P5. Further, the control circuit 1 sets the envelope control data on the basis of the above vibration duration t4 and t5 and the above tone volume data.

The above rhythm sound data and envelope data are supplied from the control circuit 1 to the sound source circuit 4. The sound source circuit 4 generates the rhythm sound to output the same through the sound system 6.

In this manner, a rhythm performance can be executed with certain rhythm sounds, when a body other than the sound plate 11 is struck with the mallet 20.

Second Embodiment

In the above first embodiment, the peak values P1, P2 and P3 corresponding to respective percussion intensities to the divided portions of the sound plate 11 are used for controlling the tone volume. But, different kinds of timbres in the same family are assigned to the divided portions of the sound plate and three kinds of timbres can be composed at the ratio of the peak values P1, P2 and P3 to produce another timbre.

More specifically, in case that for example, piano sound is selected by operation of the timbre selection switches 61 to 63 on the mallet 20, timbres in the piano sound family such as piano sound A, piano sound B and piano sound C are assigned to the respective divided portion of the sound plate 11. Then, timbres of the above piano sounds A, B and C are composed at the ratio of the peak values P1, P2 and P3, each corresponding to the percussion intensity to each divided portion of the sound plate 11. In this way, an abundant performance with delicate timbres can be obtained when the sound plate 11 is struck on different positions and with different striking intensities with the mallet 20.

Figure 10:
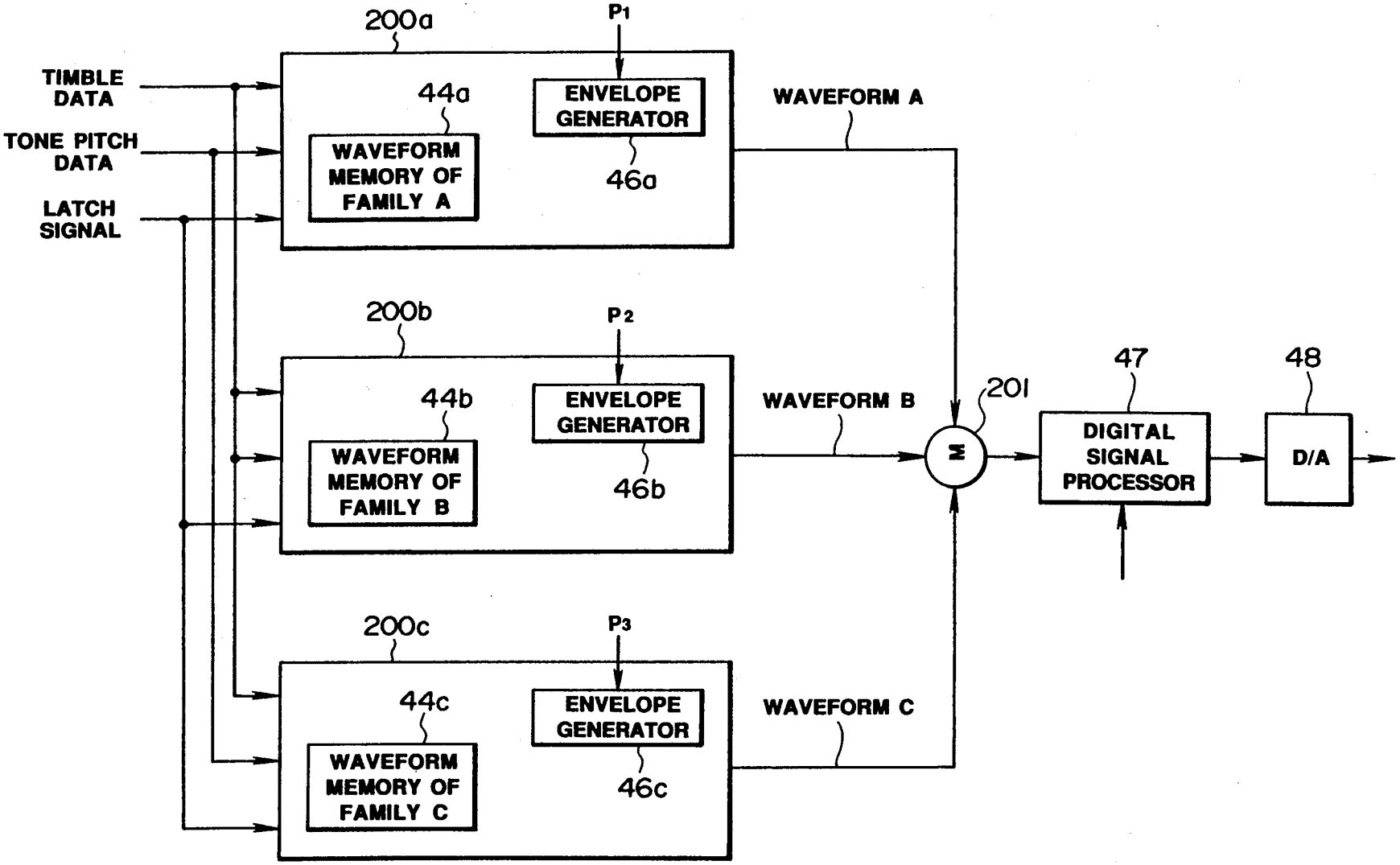
FIG. 10 is a view showing one construction of a sound source circuit used in a second embodiment according to the present invention.

FIG. 10 is a view showing one construction of the sound source circuit used in the second embodiment. In FIG. 10, circuits 200*a*, 200*b* and 200*c* are the same circuit as the sound source circuit 4 surrounded with a broken line in FIG. 4.

The sound source circuit 200*a* has a waveform memory 44*a* for storing timbres of a piano, pipeorgan, drum and so on in a family A. The sound source circuit 200*b* also has a waveform memory 44*b* for storing timbres of a piano, pipeorgan, drum and so on in a family B. Similarly, the sound source circuit 200*c* has a waveform memory 44*c* for storing timbres of a piano, pipeorgan, drum and so on in a family C.

When the same timbre data and the same tone pitch data are supplied to the sound source circuits 200*a*, 200*b* and 200*c*, waveforms of designated timbres of families A, B and C are read out from the waveform memories 44*a*, 44*b* and 44*c* of the sound source circuits 200*a*, 200*b* and 200*c*.

The peak values P1, P2 and P3 are supplied as envelope control data to the envelope generators 46*a*, 46*b* and 46*c* of the sound source circuits 200*a*, 200*b* and 200*c*. Then the envelope generators 46*a*, 46*b* and 46*c* generate amplitude envelope data proportional to the peak values P1, P2 and P3 and supply these data to the relevant digital amplifiers 45.

Therefore, the amplitude envelopes of waveforms A, B and C output from the sound source circuits 200i a, 200*b* and 200*c* will be at the ratio of the peak values P1, P2 and P3. The waveforms A, B and C are added by an adder 201 and then a digital-signal processing circuit 47 applies various effects such as echo effect, reverberation effect and the like to the added waveform. The added waveform is transferred to a D/A converter 48. The D/A converter 48 converts the added waveform to an analog musical-tone signal.

Third Embodiment

Figure 11:
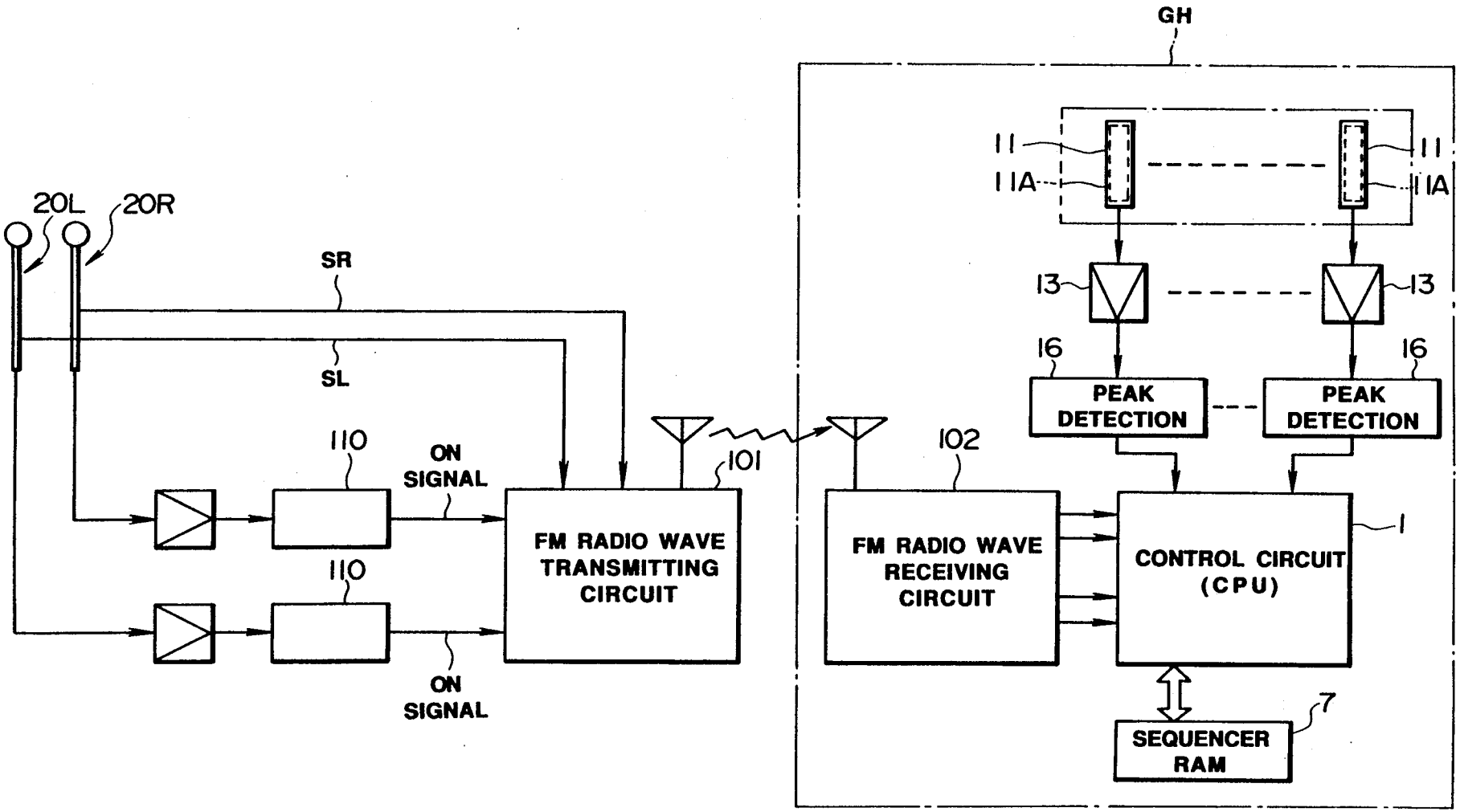
FIG. 11 is a view showing a system construction of a third embodiment of the present invention.

FIG. 11 is a view illustrating a system construction of the third embodiment applied to an electronic percussion instrument. Note that, as not shown, the same circuits as the sound source circuits 4*a* and 4*b* for the left hand mallet and the right hand mallet, the mixing circuit 100 and the sound system 6 in FIG. 1 are provided in the third embodiment.

In the third embodiment, operation signals SL and SR of switches provided on the mallet 20L (20R) and a left ON-signal (a right ON-signal) indicating the presence of the percussion operation by the mallet 20L (20R) (which ON-signal is detected by a level detection circuit 110) are frequency-modulated and transmitted by an FM radio wave transmitting circuit 101 provided in the mallet 20L (20R). The FM radio wave is received and demodulated by an FM radio wave receiving circuit 102 provided in a body GH of the musical instrument. Then, the demodulated signal is delivered to the control circuit 1.

The above operation signals SL and SR and ON-signal input to the control circuit 1 are used to control parameters of a musical tone to be generated. These signals are also stored in the sequencer RAM 7.

In this manner, various signals indicating the presence of the percussion operation by the mallet 20L (20R), timbre, effects and the like can be transmitted from the mallet 20L (20R) to the body GH of the musical instrument by means of the FM radio communication. Therefore, a cord for connecting the mallet 20L (20R) to the body GH of the musical instrument is not required. As a result, a player is allowed to play the musical instrument feeling at ease without paying any attention to the connecting cord.

Other Embodiment

It will be easily understood by those skilled in the art that the effects to be applied to musical tones are not limited to those described in the above embodiment, but other various effects such as vibrato effect, phase shift effect and the like may be applied to musical tones.

The number of switches provided on the mallet is not limited to three units but other switches in addition to above switches can be installed on the mallet.

Further, in the above embodiment, the pressure sensor element is used for sensing the percussion operation by the mallet as a striking member, but conductive gum can be used for sensing a percussion operation, impedance of which varies with contraction caused when the gum is struck.

Furthermore, in the above embodiment, the FM radio wave transmitting circuit 101 is prepared outside the mallet 20L (20R), but the FM radio wave transmitting circuit can be mounted in the mallet body 20L (20R).

What is claimed is:

1. An electronic percussion instrument, comprising:

a plurality of percussion members adapted to be struck, each provided for each of tone pitches;

percussion detection means for detecting a state of percussion imparted to said percussion members;

performance-data generation means for sequentially generating, every time at least one of said percussion members is struck, percussion data and tone pitch data, said percussion data corresponding to a state of percussion detected by said percussion detection means and said tone pitch data corresponding to the struck percussion members; and memory means for sequentially storing the percussion data and the tone pitch data sequentially generated by said performance data generation means.

2. An electronic percussion instrument according to claim 1, further comprising control means for controlling to sequentially read out the percussion data and the tone pitch data stored in said memory means and to sequentially generate musical tones, each having a tone pitch corresponding to the read-out tone pitch data in accordance with the percussion data.

3. An electronic percussion instrument according to claim 2, further comprising musical-tone generation means coupled to said control means for generating musical tones, based on a control of said control means.

4. An electronic percussion instrument according to claim 1, wherein a plurality of said percussion members are disposed in order of the musical scale.

5. An electronic percussion instrument according to claim 1, wherein said percussion detection means are prepared for each of said percussion members.

6. An electronic percussion instrument according to claim 1, further comprising control means for controlling to sequentially read out the timing data and the tone pitch data stored in said memory means and to sequentially generate musical tones, each having a tone pitch corresponding to the read out tone pitch data, at timings corresponding to the timing data.

7. An electronic percussion instrument according to claim 6, further comprising musical-tone generation means coupled to said control means for generating musical tones, based on a control of said control means.

8. An electronic percussion instrument, comprising:

a plurality of percussion members adapted to be struck, each provided for each of tone pitches;

percussion timing detection means for detecting timing of percussion imported to a plurality of said percussion members;

performance data generation means for sequentially generating, every time at least one of said percussion member is struck, timing data and tone pitch data, said timing data expressing timings of percussion detected by said percussion timing detection means and said tone pitch data corresponding to the struck percussion member; and memory means for sequentially storing the timing data and the tone pitch data sequentially generated by said performance data generation means.

9. An electronic percussion instrument, comprising:

a plurality of percussion members adapted to be struck, each provided for each of tone pitches;

percussion position detection mans for detecting a particular struck position on the percussion members from percussion imparted to a particular position on said percussion members;

performance-data generation means for sequentially generating, every time at least one of said percussion members is struck, percussion position data and tone pitch data, said percussion position data corresponding to struck positions detected by said percussion position detection means and tone pitch data corresponding to the struck percussion members; and memory means for sequentially storing the percussion position data and the tone pitch data sequentially generated by the performance-data generation means.

10. An electronic percussion instrument according to claim 9, further comprising control means for controlling to read out sequentially the percussion position data and the tone pitch data stored in said memory means and to sequentially generate musical tones, each having a tone pitch corresponding to the read out tone pitch data and taking the form of musical tone parameters corresponding to the percussion position data.

11. An electronic percussion instrument according to claim 10, further comprising musical-tone generation means coupled to said control means for generating musical tones based on a control of said control means.

12. An electronic percussion instrument, comprising:

a plurality of percussion members adapted to be struck, each provided for each of tone pitches;

percussion-intensity detection means for detecting intensity of percussion imparted to said percussion members;

performance-data generation means for sequentially generating, every time at least one of said percussion members is struck, percussion intensity data and tone pitch data, said percussion intensity data corresponding to intensity of percussion detected by said percussion-intensity detection means and said tone pitch data corresponding to the struck percussion members; and memory means for sequentially storing the percussion intensity data and the tone pitch data generated sequentially by said performance-data generation means.

13. An electronic percussion instrument according to claim 12, further comprising control means for controlling to read out sequentially the percussion intensity data and the tone pitch data stored in said memory means, and to generate sequentially musical tones, each having a tone pitch corresponding to the read out tone pitch data and taking the form of musical tone parameters corresponding to the percussion intensity data.

14. An electronic percussion instrument according to claim 13, further comprising musical-tone generation means coupled to said control means for generating musical tones based on a control of said control means.

15. An electronic percussion instrument, comprising:

a plurality of percussion members adapted to be struck, each provided for each of tone pitches;

vibration-duration detection means for duration of vibration of the percussion members, caused when the percussion member is struck;

performance-data generation means for sequentially generating, every time at least one of said percussion members is struck, vibration duration data and tone pitch data, said vibration duration data corresponding to the vibration durations detected by said vibration-duration detection means and said tone pitch data corresponding to the struck percussion members; and memory means for sequentially storing the vibration duration data and the tone pitch data generated sequentially by said performance-data generation means.

16. An electronic percussion instrument according to claim 15, further comprising control means for controlling to read out sequentially the vibration duration data the tone pitch data stored in said memory means and to generation sequentially musical tones, each having a tone pitch corresponding to the read out tone pitch data, during the time corresponding to the vibration duration data.

17. An electronic percussion instrument according to claim 16, further comprising musical-tone generation means coupled to said control means for generating musical tones based on a control of said control means.

18. An electronic percussion instrument, comprising:

a plurality of percussion members adapted to be struck, each provided for each of tone pitches;

at least one striking member used for striking said percussion member having a manually operative means;

designation-data output means for outputting every time said manually operative means is operated by a player, designation data to designate a tone parameter of a musical tone to be generated;

percussion detection means for detecting a state of percussion imparted to said percussion members by said striking member;

performance-data generation means for sequentially generating, every time at least one of said percussion members is struck, percussion data and tone pitch data, said percussion data corresponding to states of percussion detected by said percussion detection means and said tone pitch data corresponding to the struck percussion members; and memory means for sequentially storing the percussion data and the tone pitch data sequentially generated by said performance-data generation means and the designation data sequentially outputted by said designation-data output means.

19. An electronic percussion instrument according to claim 18, further comprising control means for controlling to sequentially read out the percussion data, the tone pitch data and the designation data stored in said memory means and to generate musical tones, each having tone pitches corresponding to the tone pitch data and tone volume corresponding to the percussion data, in accordance with particular musical-tone parameters corresponding to the designation data.

20. An electronic percussion instrument according to claim 19, further comprising musical-tone generation means coupled to said control means for generating musical tones based on a control of said control means.

21. An electronic percussion instrument, comprising:

at least one striking member which can be used for a striking operation having a manually operative means;

striking-state detection means provided on said striking member, for detecting a state of the striking operation of the striking member;

musical-tone parameter designation means for designating a tone parameter of a musical tone to be generated, every time said manually operative means is operated;

performance-data generation means for sequentially generating striking data and parameter data, said striking data corresponding to the states of the striking operation, when the striking operation by the striking member is executed, and said parameter data corresponding to a particular tone parameter which is designated by said tone parameter designation means when the striking operation is executed; and memory means for sequentially storing the striking data and the parameter data sequentially generated by said performance-data generation means.

22. An electronic percussion instrument according to claim 21, further comprising control means for controlling to sequentially read out the striking data and the parameter data stored in said memory means, and to generate sequentially musical tones designated by parameters corresponding to the parameter data at timings corresponding to the striking data.

23. An electronic percussion instrument according to claim 21, wherein said manually operative means comprises at least one timbre selection means, for designating timbre of a musical tone to be generated.

24. An electronic percussion instrument, comprising:

at least one striking member which can be used for a striking operation;

striking-state detection means provided on said striking member, for detecting a state of the striking operation of the striking member;

striking-data generating means for sequentially generating striking data corresponding to the states of striking operation detected by said striking-state detection means, every time the striking operation by said striking member is executed; and memory means for sequentially storing the striking data generated by said striking-data generation means.

25. An electronic percussion instrument according to claim 24, further comprising control means for controlling to sequentially read out the striking data stored in said memory means and to sequentially generate musical tones in accordance with the striking data.

26. An electronic percussion instrument according to claim 25, further comprising musical-tone generation means coupled to said control means for generating musical tones based on a control of said control means.

27. An electronic percussion instrument comprising:

a plurality of percussion members adapted to be struck, each provided for each of tone pitches;

a striking member used for striking said percussion members having a manually operative means;

percussion detection means for detecting a state of percussion applied to said percussion members to output a corresponding sensed signal;

tone-pitch data generation means for generating tone pitch data corresponding to at least one of said percussion members which is struck on the basis of the sensed signal output by the percussion detection means; and control means for controlling a tone parameter of a musical tone having a tone pitch corresponding to the tone pitch data generated in accordance with an operation of said manually operative means.

28. An electronic percussion instrument according to claim 27, further comprising musical-tone generation means for generating a musical tone having a tone pitch corresponding to the tone pitch data, responding thereto when the tone pitch data is generated by said tone pitch-data generation means.

29. An electronic percussion instrument according to claim 27, further comprising:

transmitting means for transmitting the indication signal output by said indication-signal output means by means of an electric wave; and receiving means provided on said percussion members, for receiving the indication signal transmitted by said transmitting means to output said indication signal to said control means.

30. An electronic percussion instrument according to claim 27, wherein said manually operative means comprises at least one timbre-selection means, for selecting timbre of a musical tone to be generated.

31. An electronic percussion instrument according to claim 27, wherein said manually operative means is pitch alteration means, for altering a tone pitch of a musical tone to be generated.

32. An electronic percussion instrument according to claim 27, wherein said manually operative means is rapid tone-cease instruction means, for instructing to cease rapidly sounding of a musical tone being generated.

33. An electronic percussion instrument according to claim 27, wherein said manually operative means is musical tone keeping means, for instructing to keep on generating a musical tone which has been generated.

34. An electronic musical instrument according to claim 27, wherein said manually operative means is effect adding means, for instructing to add a particular effect to a musical tone to be generated.

* * * * *